US007142806B2

(12) United States Patent
Kimura et al.

(10) Patent No.: US 7,142,806 B2
(45) Date of Patent: Nov. 28, 2006

(54) IMAGE FORMING APPARATUS HAVING SHEET RETAINING FUNCTION

(75) Inventors: Kuniyasu Kimura, Toride (JP); Takayuki Fujii, Tokyo (JP); Yasuo Fukatsu, Abiko (JP); Toshiyuki Miyake, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 11/082,748

(22) Filed: Mar. 17, 2005

(65) Prior Publication Data

US 2005/0207811 A1 Sep. 22, 2005

(30) Foreign Application Priority Data

Mar. 22, 2004 (JP) ..... 2004-082410
Mar. 9, 2005 (JP) ..... 2005-065360

(51) Int. Cl.
*G03G 15/00* (2006.01)

(52) U.S. Cl. ..... 399/401; 399/407

(58) Field of Classification Search ..... 399/13, 399/396, 401–410
See application file for complete search history.

(56) References Cited

U.S. PATENT DOCUMENTS 5,241,355 A * 8/1993 Yamashita et al. ..... 399/407
5,778,300 A 7/1998 Murakami

FOREIGN PATENT DOCUMENTS

JP 03067699 A * 3/1991
JP 05012262 A * 1/1993

* cited by examiner

*Primary Examiner*—David M. Gray
*Assistant Examiner*—Ryan Gleitz
(74) *Attorney, Agent, or Firm*—Canon U.S.A. Inc. I.P. Div

(57) ABSTRACT

An image forming apparatus capable of connecting to a sheet post-processing equipment, includes an image data inputting unit which inputs a plurality of pages of image data to be formed as images on sheets; an image forming unit configured to form the image on the sheet based on the image data inputted with the inputting unit; a retaining unit including a first conveying path branching from a second conveying path of the sheet post-processing equipment, the retaining unit temporarily retaining the sheet, and then while the sheet post-processing equipment is performing post-processing of a sheet bundle, conveying the sheet to the sheet post-processing equipment; and a control unit which differentiates an order of pages on which the image is formed from an order of pages at a time of normally forming the image in the sheet bundle, to which the sheet post-processing equipment performs the post-processing.

2 Claims, 23 Drawing Sheets

IMAGE FORMING APPARATUS HAVING SHEET RETAINING FUNCTION

BACKGROUND OF THE INVENTION

1. Field of the Invention

The present invention relates to an image forming apparatus such as a copying machine and a laser-beam printer, and more particularly to the control of an image forming apparatus in case of connecting a piece of post-processing equipment for performing stapling processing, punching processing or the like to a sheet after image formation thereon.

2. Description of the Related Art

Conventionally, for performing various kinds of processing such as stapling, punching, folding, binding to sheets on which images have been formed, an image forming apparatus capable of connecting a piece of post-processing equipment to the discharge port of the main body of the image forming apparatus has been provided.

For preventing the sheets to be discharged at even intervals from the main body of an image forming apparatus from hindering the processing of a post-processing unit in case of making a piece of post-processing equipment perform post-processing, it is necessary to hold a large interval between the sheets to be discharged, or to buffer (retain) the sheets to be discharged at the former stage of the post-processing unit. Among inexpensive apparatus having low level productivity, there is one widening the intervals of the sheets to be discharged, but generally a lot of pieces of post-processing equipment has the buffer function for heightening the level of productivity.

Moreover, an image forming apparatus performing the control of preventing the lowering of the level of productivity at the time of a two-sided copying mode previously has been proposed (for example, U.S. Pat. No. 5,778,300).

However, the above-mentioned conventional image forming apparatus has a problem of being large in size and increasing in cost of the main body of the image forming apparatus and a piece of post-processing equipment owing to the space for a buffer unit and a driving mechanism in the case where the buffer function is disposed in the inside of the main body of the image forming apparatus or in the inside of the post-processing equipment.

SUMMARY OF THE INVENTION

The present invention is directed to an image forming apparatus including a buffer function which does not increase the size and the cost of the main body of the image forming apparatus and a post-processing equipment and does not lower the productivity of image formation in case of performing post-processing.

In one aspect of the present invention, an image forming apparatus operable to form images on sheets and connectable to a sheet post-processing equipment includes: an image forming unit which selectively forms an image on front and back sides of a sheet; a reversing unit configured to reverse the sheet between the front and back sides so as to facilitate forming an image on the back side after an image has been formed on the front side by the image forming unit; a two-sided conveying unit configured to convey the sheet having been reversed by the reversing unit to the image forming unit to form an image on the back side; a retaining unit temporarily retaining the sheet on a conveying path of the two-sided conveying unit with the reversing unit and the two-sided conveying unit, and then discharging the retained sheet to the sheet post-processing equipment when a post-processing procedure is selected; and a conveyance control unit controlling a conveying speed, at a time of discharging the sheet from the two-sided conveying unit to the sheet post-processing equipment, to be faster than a conveying speed at a time of conveying the sheet from the reversing unit to the two-sided conveying unit when the post-processing procedure is selected.

In another aspect of the present invention, an image processing apparatus installable to a sheet post-processing equipment, including: an image forming unit which forms an image on a sheet; a first conveying portion conveying the sheet having the image formed thereon on a first conveying path; a retaining unit retaining the sheet conveyed by the first conveying portion in a second conveying path upstream with respect to the sheet post-processing equipment, wherein a conveying direction of the retained sheet discharged from the second conveying path is reverse to a conveying direction of the sheet conveyed to the second conveying path; a second conveying portion conveying the sheet from the retaining unit to the sheet post-processing equipment; and a conveyance control unit controlling a conveying speed of the sheet out of the second conveying path to be faster than a conveying speed of the sheet into the second conveying path.

In yet another aspect of the present invention, an image forming apparatus capable of connecting to a sheet post-processing equipment, including: an image data inputting unit which inputs a plurality of pages of image data to be formed as images on sheets; an image forming unit configured to form the image on the sheet based on the image data inputted with the inputting unit; a retaining unit including a first conveying path branching from a second conveying path of the sheet post-processing equipment, the retaining unit temporarily retaining the sheet having the image formed thereon by the image forming unit, and then while the sheet post-processing equipment is performing post-processing of a sheet bundle, conveying the sheet to the sheet post-processing equipment; and a control unit which differentiates an order of pages on which the image is formed from an order of pages at a time of normally forming the image in the sheet bundle, to which the sheet post-processing equipment performs the post-processing.

Other features and advantages of the present invention will become apparent to those skilled in the art upon reading of the following detailed description of embodiments thereof when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

Figure 1:
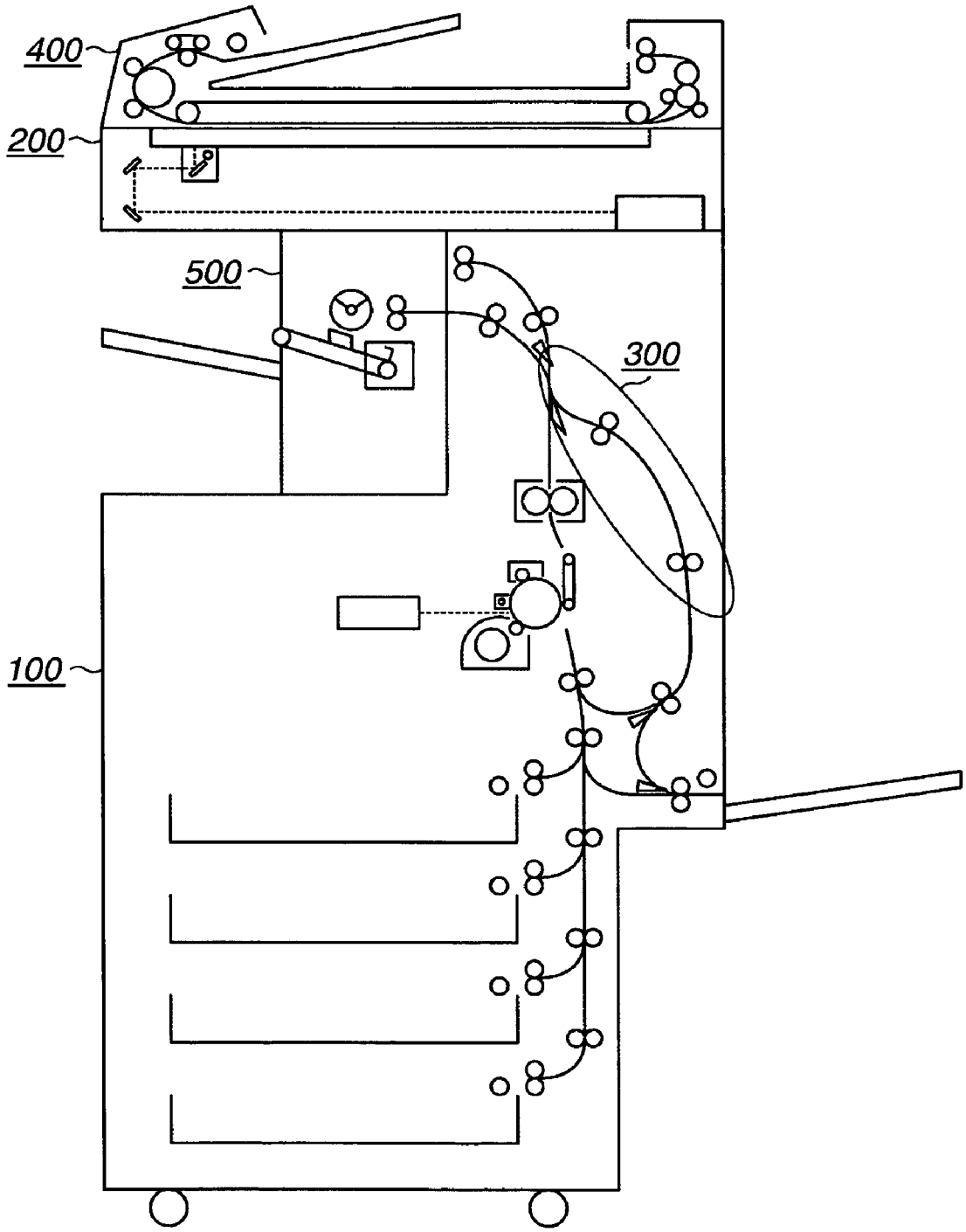
FIG. 1 is a sectional view showing the configuration of an image forming apparatus according to an embodiment of the present invention.

FIG. 1 is a sectional view showing the main configuration of an image forming apparatus according to an embodiment of the present invention.

The image forming apparatus is composed of a printer 100 and an image reader 200, and is therein provided with an image forming unit and a retaining unit 300 for retaining a sheet on which an image has been formed by the image forming unit. Moreover, a document feeder 400 is installed in the image reader 200, and a finisher (post-processing unit) 500 for performing desired post-processing to the sheet on which the image has been formed is connected to the printer 100.

The finisher 500 is a device for performing the processing of sheets such as an aligning operation, a binding operation, a bundle discharging operation and the like, and the retaining unit 300 is installed on the upstream side (former stage) of the finisher 500. The retaining unit 300 utilizes a two-sided conveying path for re-conveying a sheet, or an image formation medium, to the image forming unit for forming an image on the other surface of the sheet after an image has been formed on one surface of the sheet by the image forming unit. Moreover, a control unit for controlling the speed of carrying a sheet into the retaining unit 300 to be different from the speed of carrying out the sheet from the retaining unit 300 is provided.

First Embodiment

Figure 2:
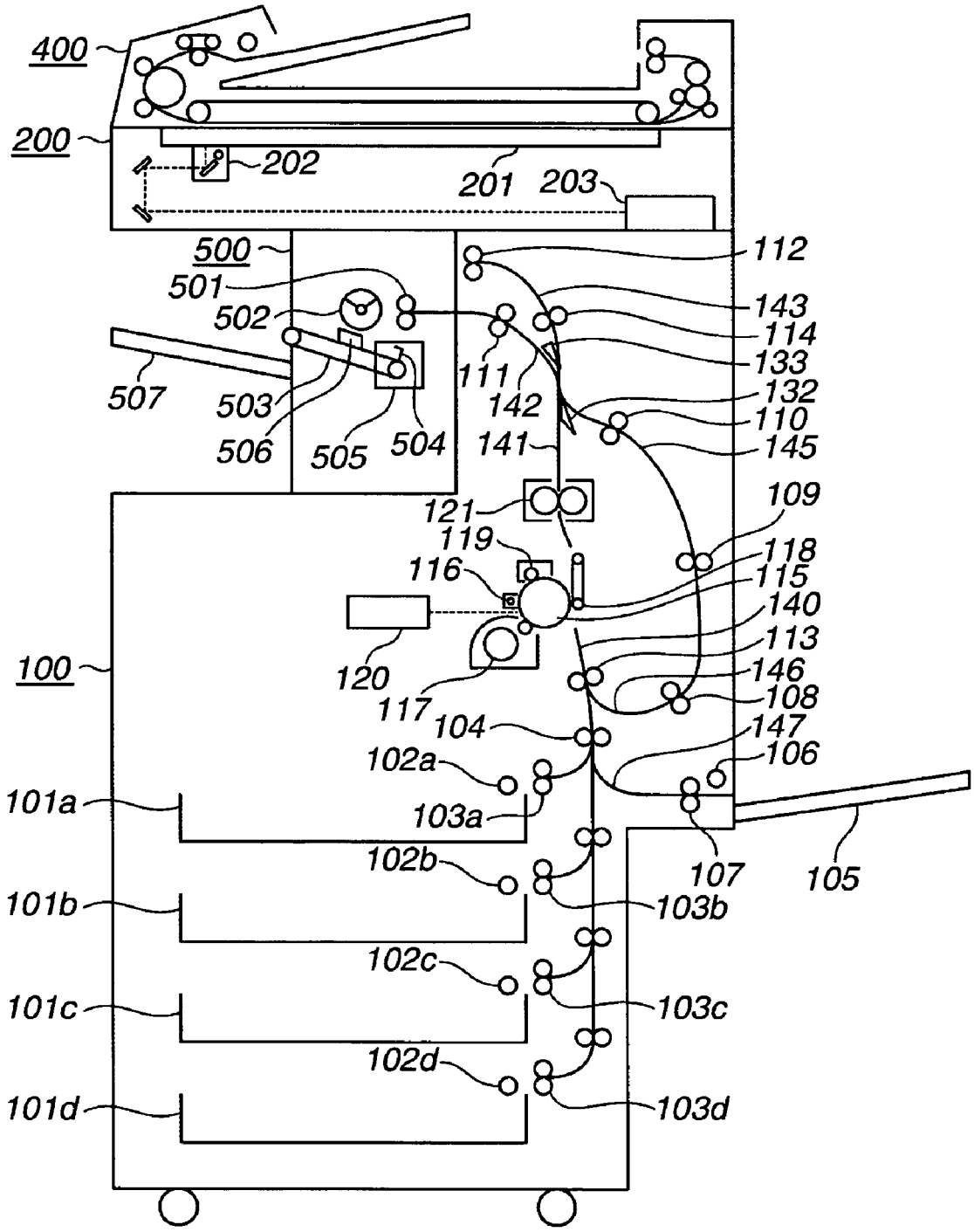
FIG. 2 is a sectional view showing the configuration of an image forming apparatus according to a first embodiment of the present invention.

FIG. 2 is a longitudinal sectional view showing the configuration of an image forming apparatus according to a first embodiment of the present invention.

The document feeder 400 feeds originals set upwards on an original tray one by one from the top page in a left direction, and stops the fed original at a predetermined position on a platen glass 201 through a bent path. The image reader 200 scans the original in this state with a scanner unit 202 from the left side of the drawing to the right direction to read the original.

At the time of the scanning by the scanner unit 202, the reading surface of the original is irradiated with light from a lamp of the scanner unit 202, and the reflected light from the original is guided to a lens through a mirror. The light having passed through the lens is focused on an imaging surface of an image sensor 203. The image optically read here is converted into image data by the image sensor 203 to be outputted. The image data outputted from the image sensor 203 receives predetermined processing by an image signal control unit 281 shown in FIG. 3, which will be described later. After that, the processed image data is inputted into an exposure control unit 120 of the printer 100 as a video signal.

Incidentally, in FIG. 2, reference numerals 102*a* to 102*d* denote pickup rollers, reference numerals 103*a* to 103*d* denote feeding rollers, reference numerals 104 and 107 to 109 denote conveying rollers, a reference numeral 106 denotes a sensor, a reference numeral 116 denotes a charger, and a reference numeral 119 denotes a cleaner.

Figure 4:
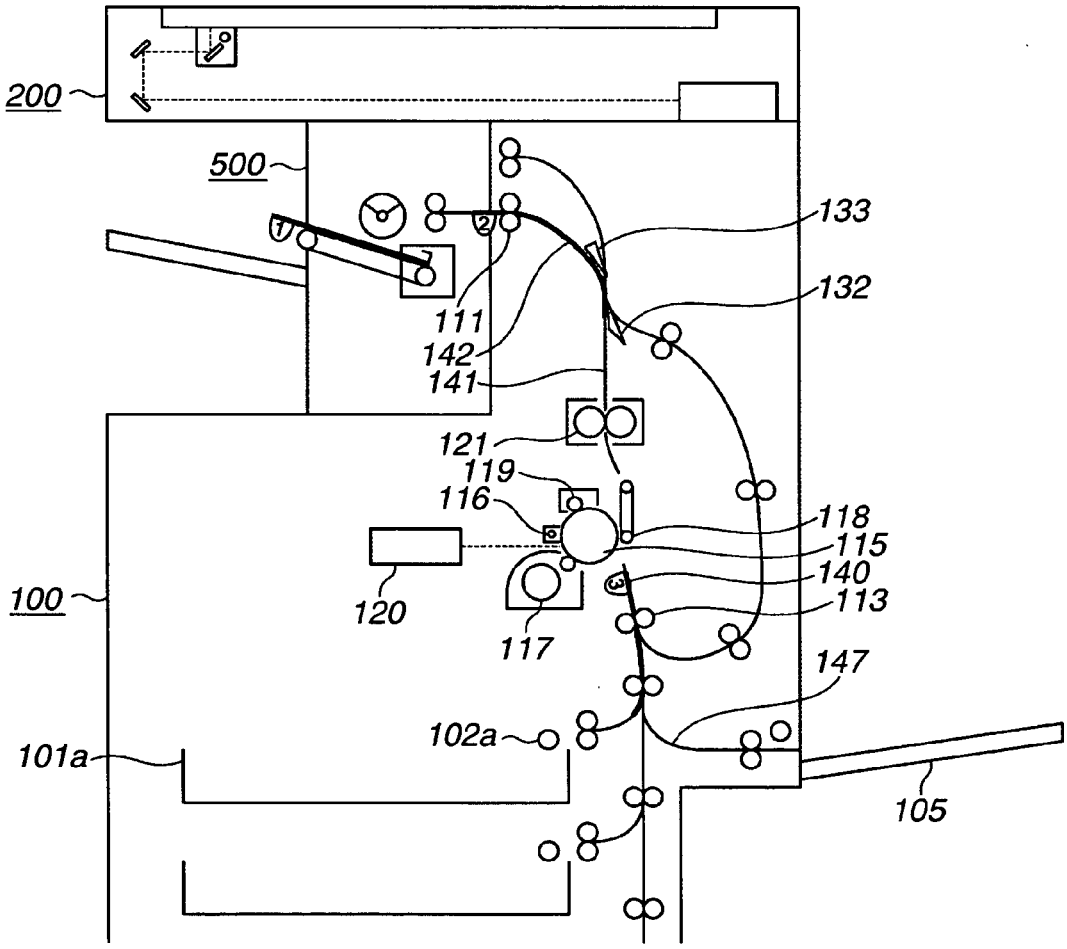
FIG. 4 is an explanatory view showing a one-sided image forming operation of the image forming apparatus according to the first embodiment.

Next, the operation of a one-sided mode for performing image formation on one side of a sheet is described with reference to FIG. 4.

The exposure control unit 120 of the printer 100 modulates a laser beam on the basis of an input video signal, and outputs the modulated laser beam. The modulated laser beam is scanned by a polygon mirror (not shown) while being irradiated on a photosensitive drum 115. Thereby, an electrostatic latent image is formed on the photosensitive drum 115 according to the scanning laser beam.

The electrostatic latent image formed on the photosensitive drum 115 is visualized as an image of a developer by the developer fed from a developing machine 117. Moreover, a sheet fed from each of cassettes 101*a* to 101*d* or a manually paper feeding tray 105 by being guided by a conveying path 147 is knocked against resist rollers 113 by the front edge of the sheet, and stops once there. After that, the sheet is conveyed to a position between the photosensitive drum 115 and a transferring unit 118 at the timing synchronizing with the start of the irradiation of the laser beam. Then, the developer image formed on the photosensitive drum 115 is transferred to the sheet fed by the transferring unit 118. The inclination of the sheet is corrected by the temporary stop of the sheet by being knocked against the resist rollers 113 by the front edge of the sheet.

The sheet on which the developer image has been transferred is conveyed to a fixing unit 121, and the fixing unit 121 presses this sheet in the state of contacting with it while heating to fix the developer image on the sheet. The sheet having passed through the fixing unit 121 is guided to a conveying path 142 by a flapper 133, and is discharged to the outside (finisher 500) out of the printer 100 through discharge rollers 111. At this time, because the sheet is discharged in the state in which the image formation surface thereof faces downwards (facedown), the order of sheets after the discharging is the correct order of pages in the case where image formation is performed in order from the first page.

Moreover, the operation in the case where a two-sided mode for performing image formation on both sides of a sheet is set is described with reference to FIGS. 5A to 5G.

Similar to the case of one-sided mode, a sheet fed from each of the cassettes 101*a* to 101*d* or the manual paper feeding tray 105 is knocked against the resist rollers 113 by the front edge of the sheet. After that, the sheet is conveyed to a position between the photosensitive drum 115 and the transferring unit 118. Then, the sheet passes through the fixing unit 121, and image formation is performed on one surface of the sheet. The sheet is guided to a conveying path 143 from a conveying path 141 by the switching of the flapper 133, and stops in the state of being nipped by reverse rollers 112 (see FIG. 5A).

Then, when a flapper 132 is switched and the reverse rollers 112 are driven in reverse, the sheet is guided from the conveying path 143 to a two-sided conveying path 145 (see FIG. 5B), and then is guided to a conveying path 146. Thus, the sheet is again knocked against the resist rollers 113 by the front edge to stop there (see FIG. 5C). At this point, the front and the back of the sheet have been reversed.

Figure 5B:
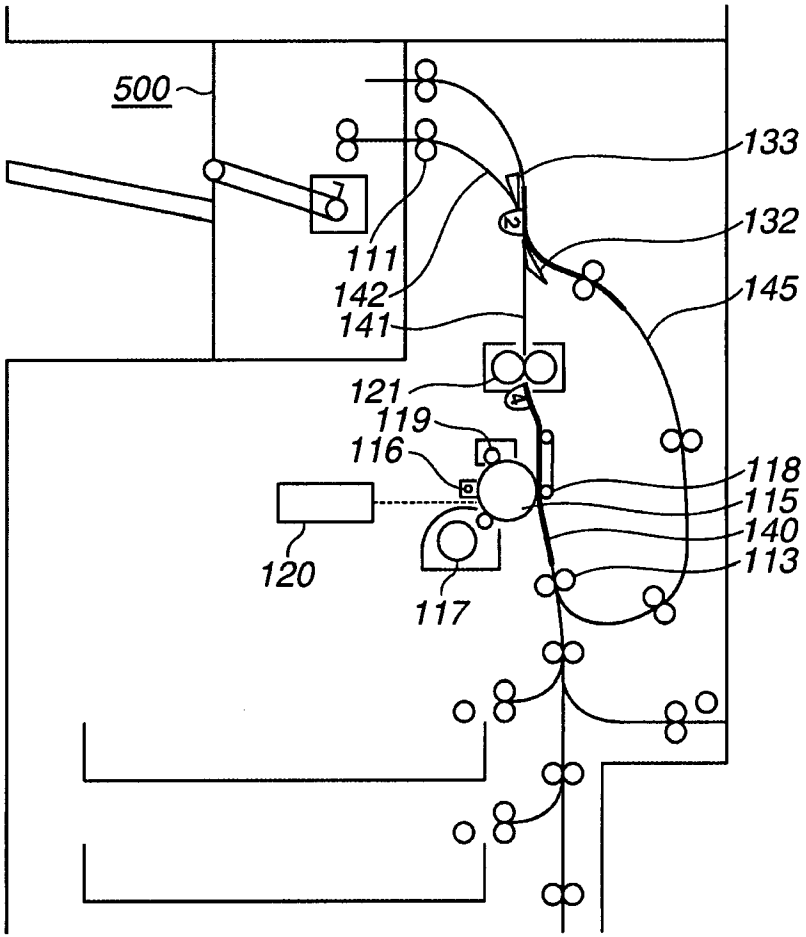
FIGS. 5A, 5B, 5C, 5D, 5E, 5F and 5G are explanatory views showing a two-sided image forming operation of the image forming apparatus according to the first embodiment.
Figure 5A:
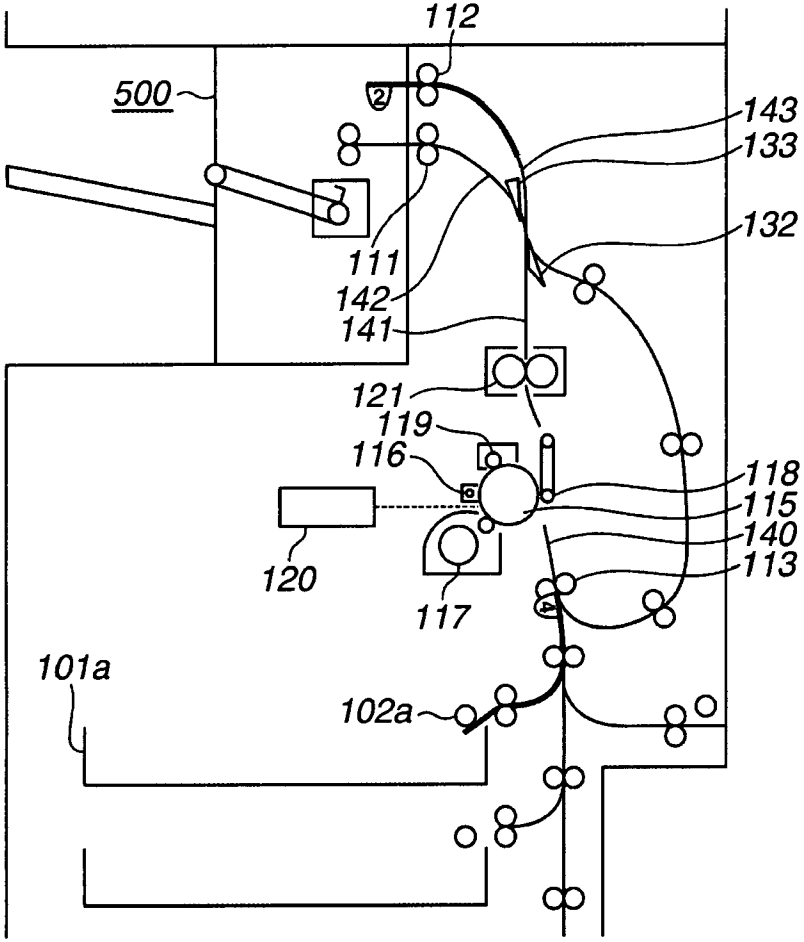
Figure 5D:
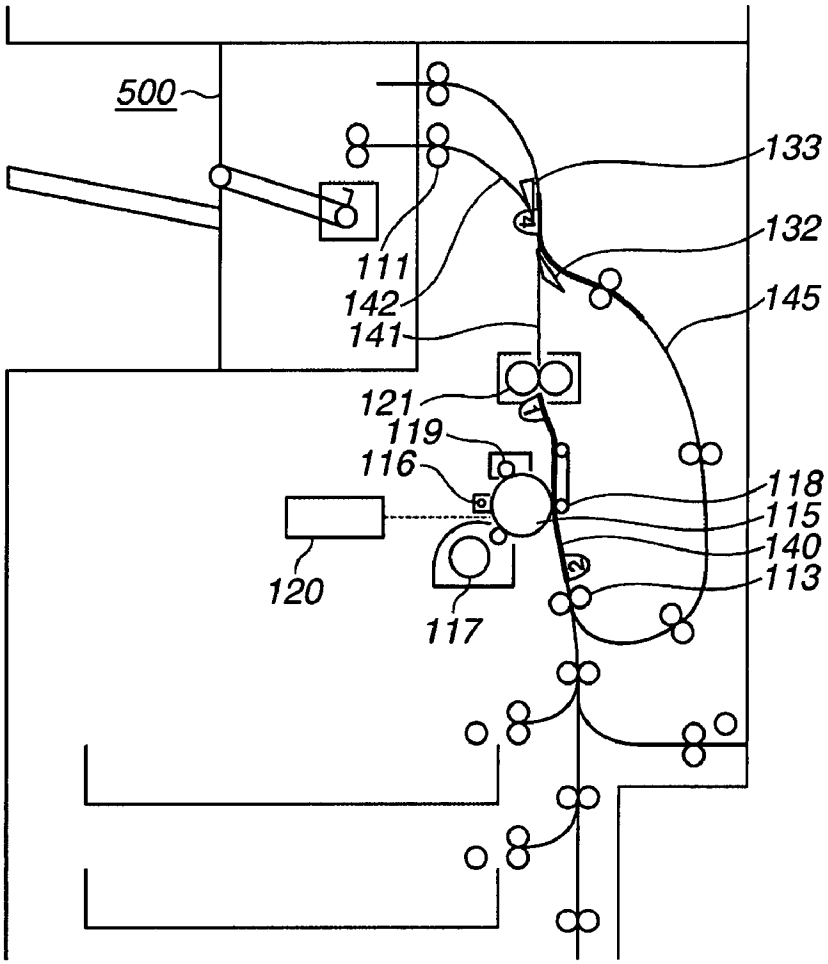
Figure 5C:
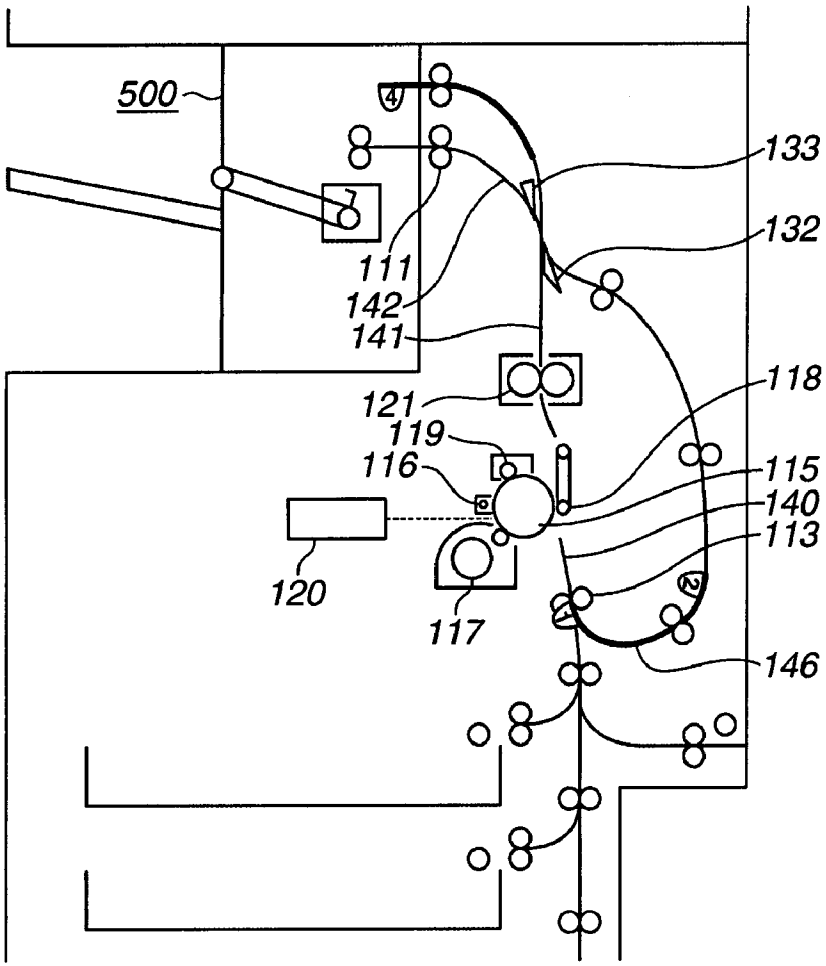
Figure 5F:
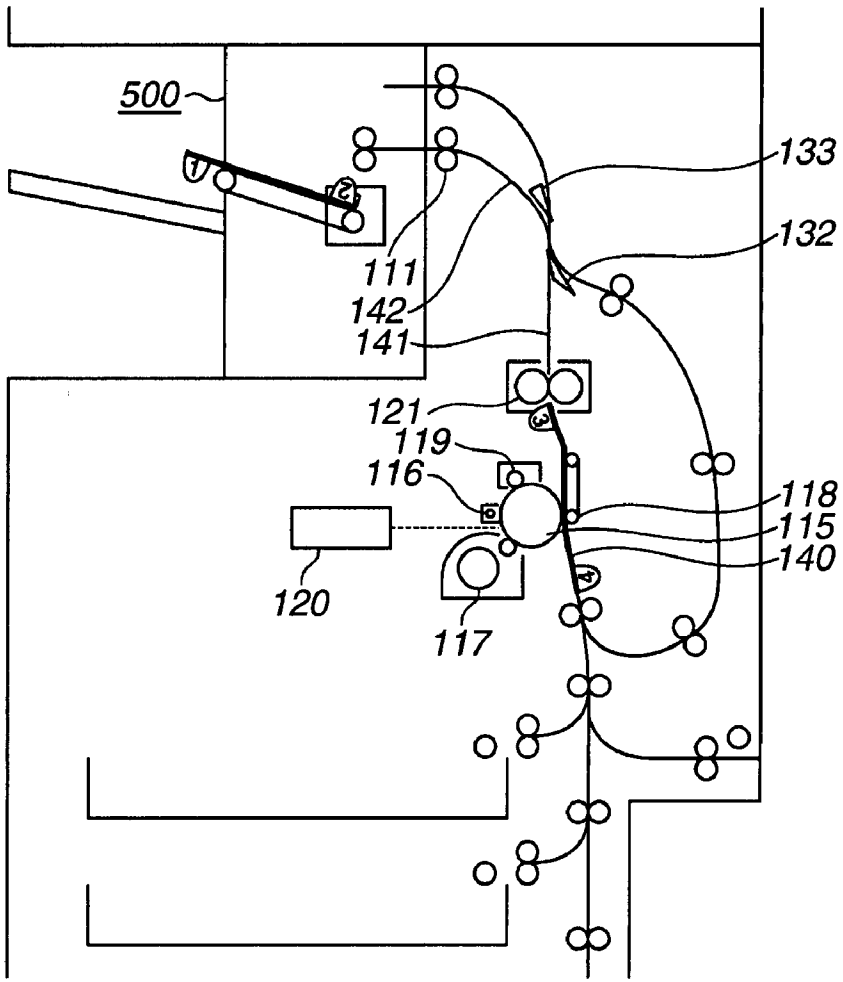
Figure 5E:
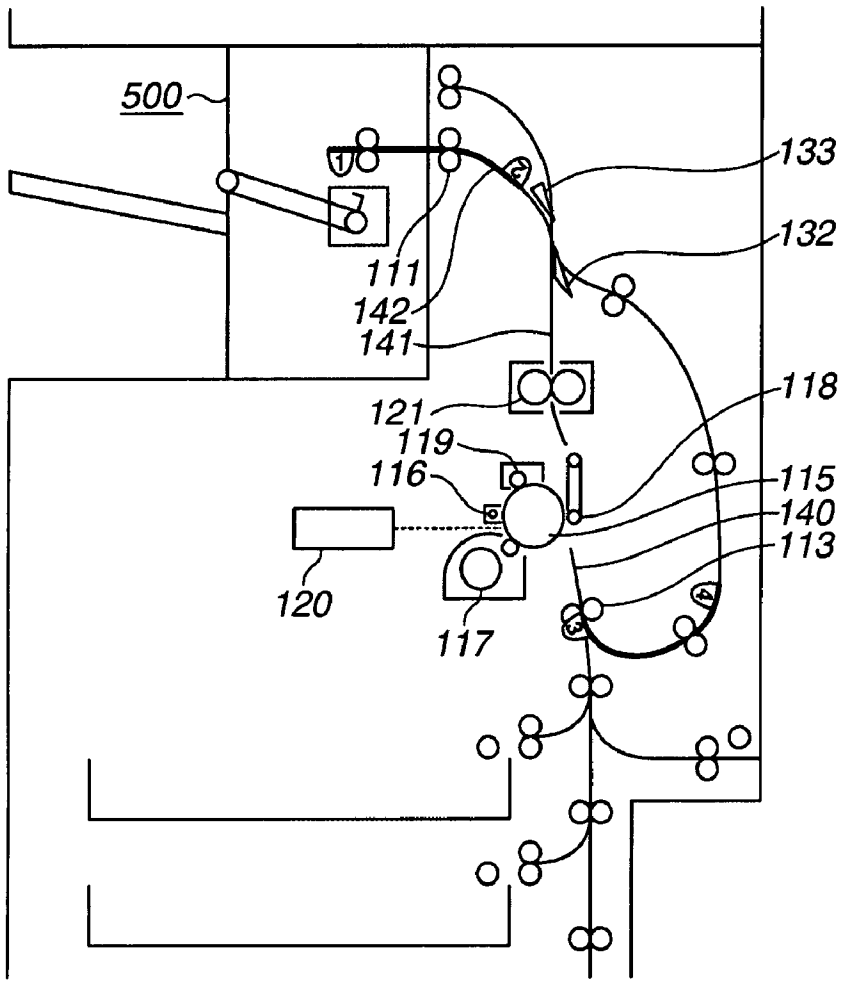
Figure 5G:
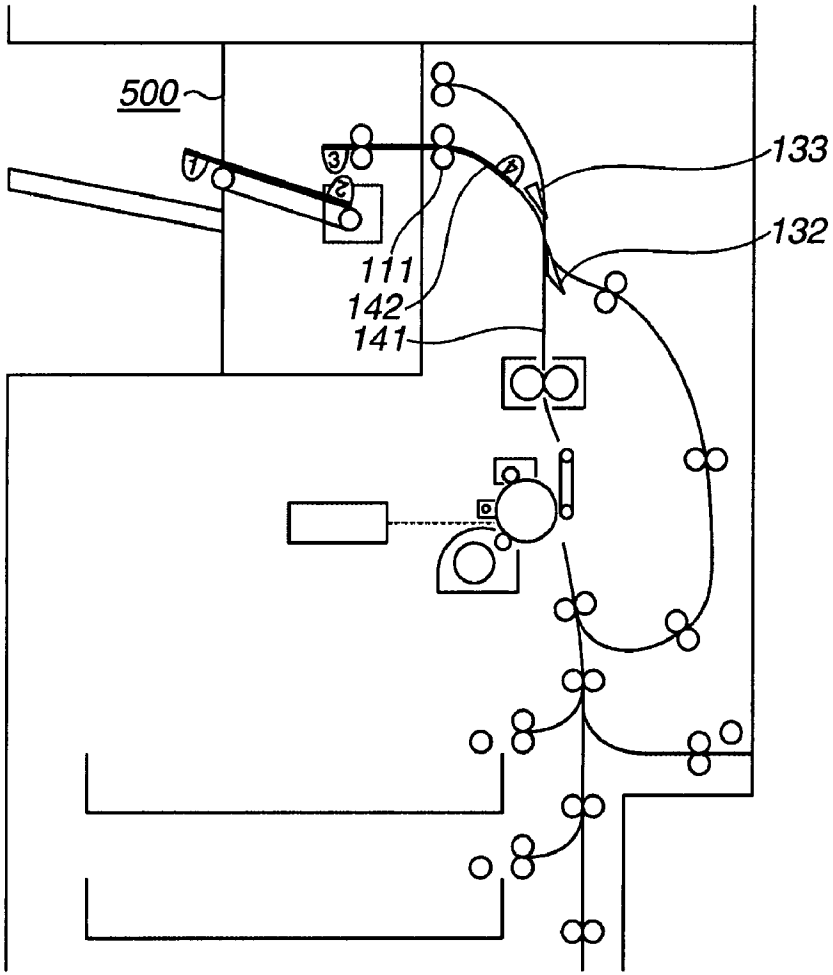

After that, the sheet is again fed to a position between the photosensitive drum 115 and the transferring unit 118, and image formation is performed on the other surface of the sheet through the fixing unit 121 (see FIG. 5D). Then, the flapper 133 is switched, and the sheet is guided from the conveying path 141 to the conveying path 142 (see FIG. 5E) to be discharged from the printer 100 to the outside (finisher 500) through the discharge rollers 111 (see FIG. 5F). Image formation is successively performed (see FIG. 5G).

Figure 6:
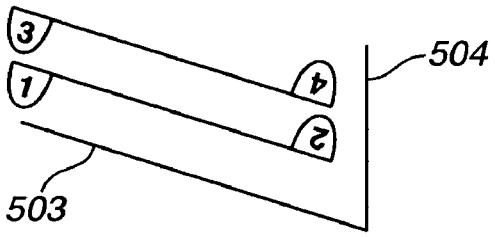
FIG. 6 is an explanatory view showing a state in which a sheet bundle is loaded on an intermediate processing tray at the time of two-sided image formation in the image forming apparatus according to the first embodiment.

Hereupon, in the case of the two-sided mode, because the sheet is discharged in the state in which the surface of the sheet on which the later image formation is performed faces downwards, the corresponding image formation onto the reverse side of the sheet is previously performed for adjusting the order of page numbers when the sheet is discharged from the printer 100 to the outside, as shown in FIG. 6. A reference numeral 503 in FIG. 6 denotes a discharged paper bundle belt, and a reference numeral 504 denotes a stopper plate.

Moreover, in the case where image formation is performed on the two sides of a plurality of sheets as shown in FIGS. 5A to 5G, the image formation on the plurality of sheets is performed in parallel in the first embodiment. However, the image formation may be performed in such a way that the image formation of both the front and the back sides of a sheet is performed before the start of the image formation on the next sheet.

A sheet discharged from the printer 100 is sent to the finisher 500, and the sent sheet is discharged onto a bundled sheet discharging belt 503 by the discharge rollers 501 of the finisher 500. In this case, an intermediate processing tray having low friction is provided at a position higher than the bundled sheet discharging belt 503 by several millimeters in parallel with the bundled sheet discharging belt 503, and more correctly, the sheet is discharged on the intermediate processing tray. Then, the discharged sheet falls towards the lower right direction in FIG. 2 by its own weight along the intermediate processing tray (bundled sheet discharging belt 503 ), which is obliquely provided. Moreover, a fan-shaped returning roller 502 rotates counterclockwise, and consequently a friction member formed on an arc portion of the returning roller 502 abuts against the sheet. The friction member also works to make the sheet fall into the lower right direction, and makes the edge of the sheet knock against the stopper plate 504. Thereby, the aligning operation of the sheet in the longitudinal direction (sending direction) is performed.

Moreover, an aligning plate 506 is formed on each of the front side and the back side of the intermediate processing tray, and the aligning plates 506 are driven at every discharge of a sheet onto the intermediate processing tray to perform the aligning operation of the sheets on the intermediate processing tray in their transverse direction (width direction). Then, when a predetermined number of sheets has been discharged to be loaded on the intermediate processing tray, the bundled sheet discharging belt 503 is driven to discharge the sheets onto a stack tray 507.

Figure 3:
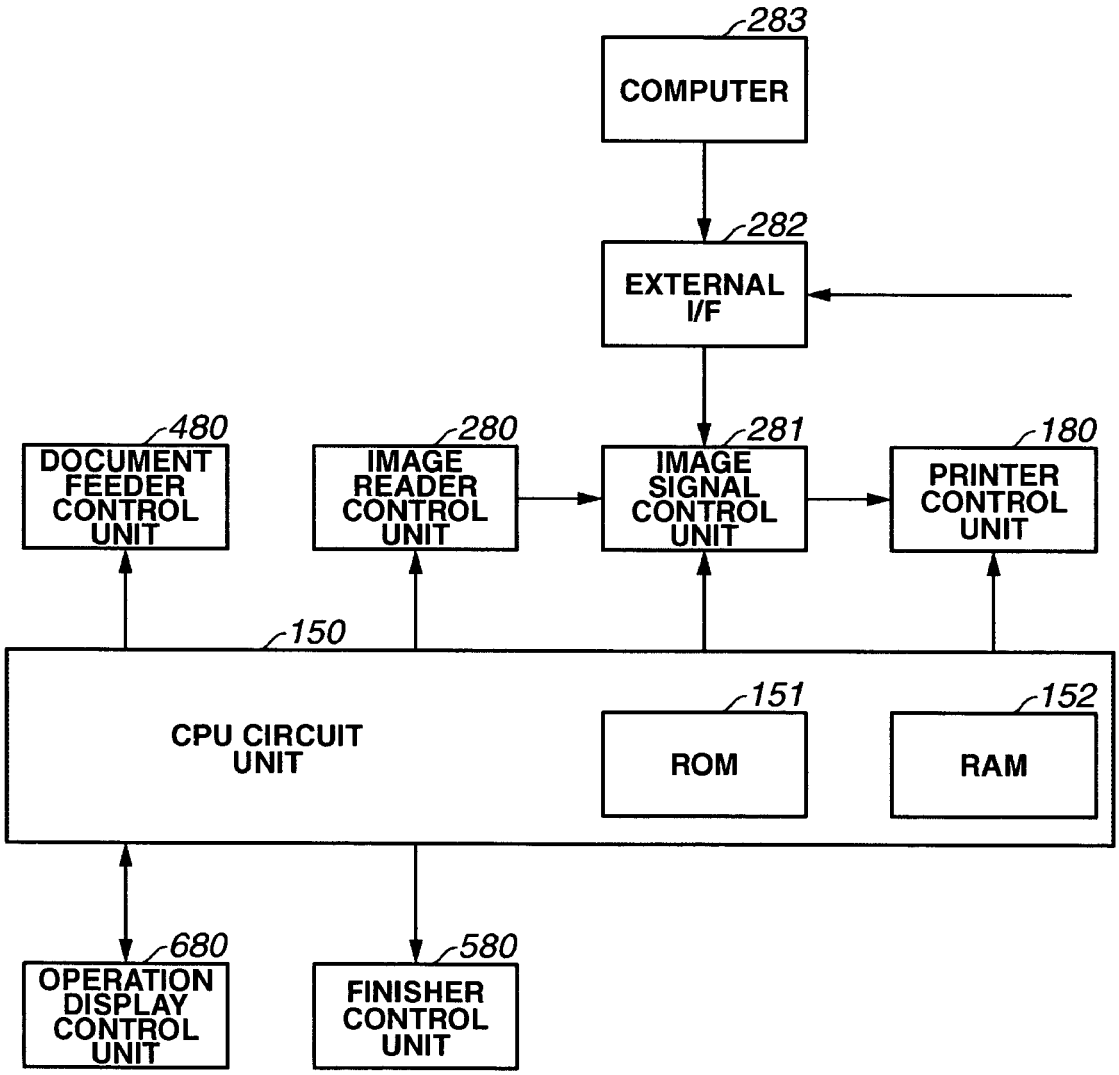
FIG. 3 is a block diagram showing the configuration of a control system of the image forming apparatus according to the first embodiment.

Next, the configuration of a controller conducting the control of the image forming apparatus according to the first embodiment is described with reference to FIG. 3. FIG. 3 is a block diagram showing the configuration of the controller of the control system conducting the control of the image forming apparatus shown in FIG. 2.

The controller, as shown in FIG. 3, includes a CPU circuit unit 150. The CPU circuit unit 150 includes a CPU (not shown), a ROM 151 and a RAM 152 therein, and collectively controls each of the following blocks in accordance with a control program stored in the ROM 151, a document feeder control unit 480, an image reader control unit 280, the image signal control unit 281, an external interface (I/F) 282, a computer 283, a printer control unit 180, an operation display control unit 680 and a finisher control unit 580. The RAM 152 temporarily holds control data, and is used as a work area for arithmetic processing accompanying the control.

The document feeder control unit 480 performs the driving control of the document feeder 400 on the basis of the instructions from the CPU circuit unit 150. The image reader control unit 280 performs the driving control of the above-mentioned scanner unit 202, the image sensor 203 and the like, and transfers an analog image signal output from the image sensor 203 to the image signal control unit 281.

The image signal control unit 281 converts the analog image signal from the image sensor 203 to a digital signal before performing various kinds of processing thereof. Then, the image signal control unit 281 converts the processed digital signal to a video signal to output the video signal to the printer control unit 180. Moreover, the image signal control unit 281 performs various kinds of processing of a digital image signal input from the computer 283 through the external I/F 282, and converts the digital image signal to a video signal to output the video signal to the printer control unit 180. The processing operation of the image signal control unit 281 is controlled by the CPU circuit unit 150. The printer control unit 180 controls the above-mentioned exposure control unit 120, the photosensitive drum 115, the developing machine 117 and the transferring unit 118 on the basis of the input video signal to perform image formation, and controls each of the conveying rollers such as the discharge rollers 111, the reverse rollers 112, the resist rollers 113 and the like to perform the conveyance control of sheets.

The operation display control unit 680 performs the exchanges of information between an operation display unit 600 and the CPU circuit unit 150. The operation display unit 600 includes a plurality of keys for setting various functions pertaining to the image formation, a display unit for displaying the information indicating a set state, and the like. The operation display unit 600 outputs a key signal corresponding to the operation of each of the keys to the CPU circuit unit 150, and displays the corresponding information on the display unit on the basis of a signal from the CPU circuit unit 150.

Figure 7:
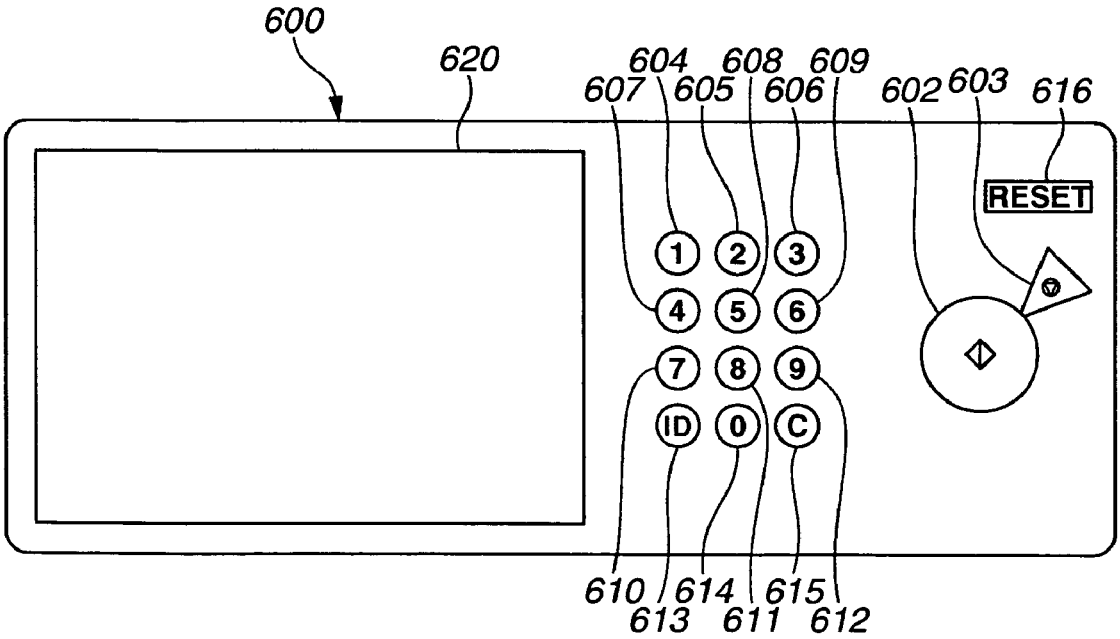
FIG. 7 is an explanatory view showing an operation display unit of the image forming apparatus according to the first embodiment.

FIG. 7 is a view showing the operation display unit 600 in the image forming apparatus of FIG. 2.

On the operation display unit 600, there are arranged a start key 602 for starting an image formation operation, a stop key 603 for suspending an image formation operation, numeric keys 604 to 612 and 614 for setting a number of sheets or the like, an ID key 613, a clear key 615, a reset key 616 and the like. Moreover, a liquid crystal display unit 620 forming a touch panel thereon is disposed, and then soft keys can be formed on the screen of the display unit 620.

Figure 8A:
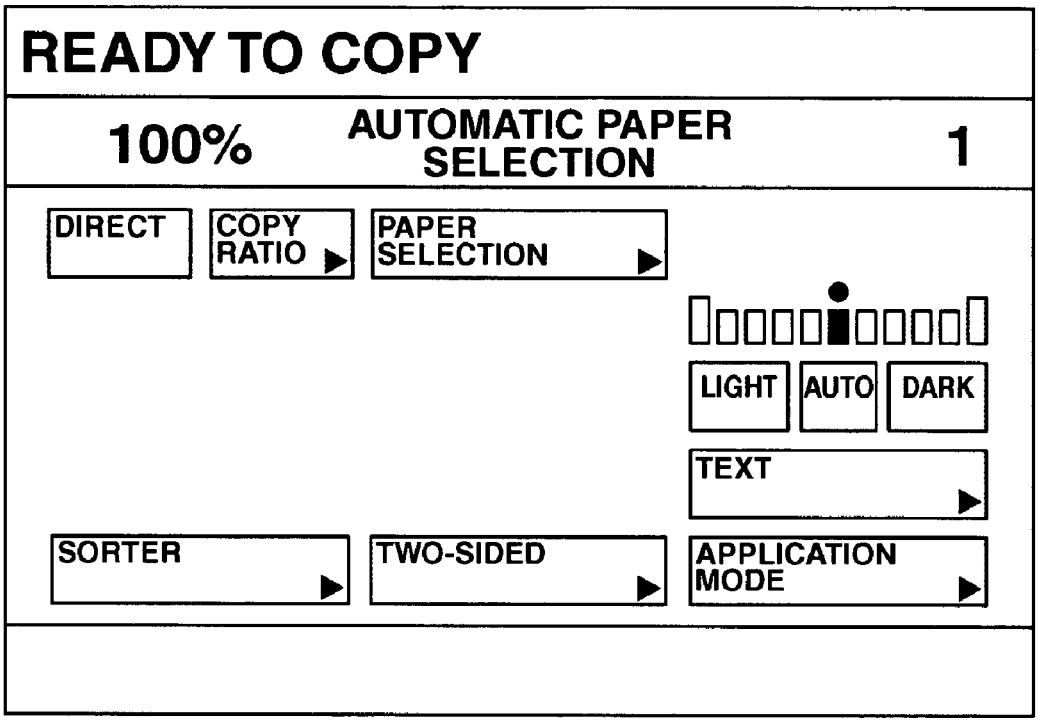
FIGS. 8A and 8B are explanatory views showing a display unit at the time of the selection of a post-processing mode of the image forming apparatus according to the first embodiment.
Figure 8B:
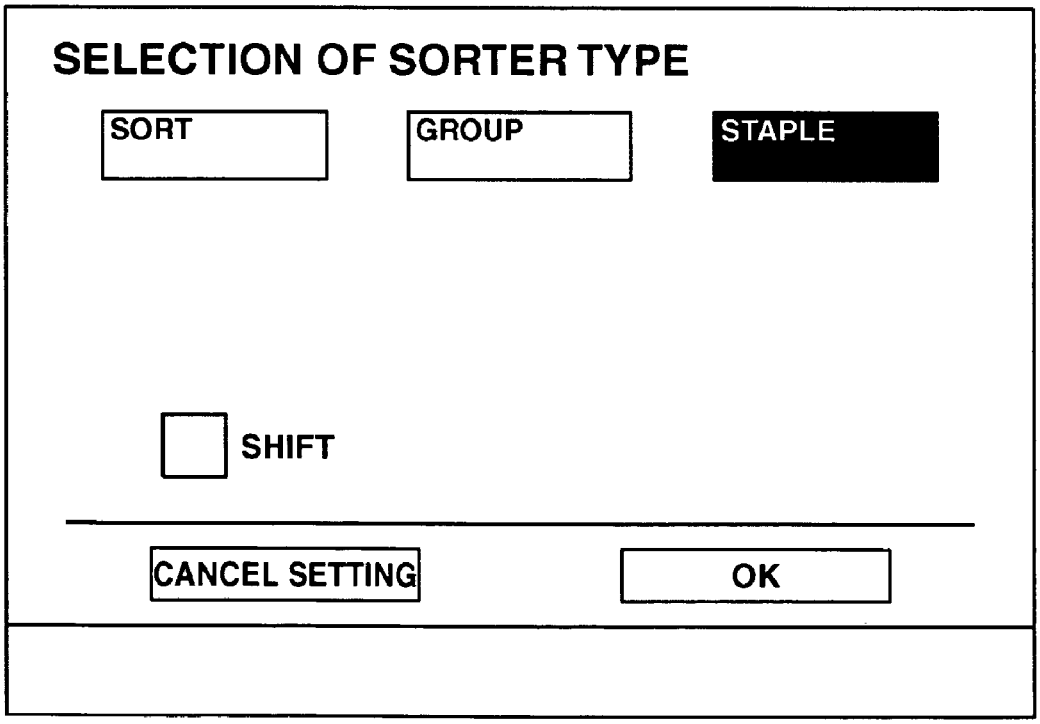

For example, the image forming apparatus of the first embodiment includes each processing mode such as a non-sort mode (group mode), a sort mode, a staple sort mode (binding mode) and the like as the post-processing mode of the finisher 500. When such a processing mode is set, the setting is performed by an input operation from the operation display unit 600. FIGS. 8A and 8B are views showing display screens of the display unit 620 at the time of the selection of the post-processing mode. When a "sorter" key, one of the soft keys, is selected in an initial screen shown in FIG. 8A, a menu selection screen shown in FIG. 8B is displayed on the display unit 620, and the setting of the processing mode is performed by using the menu selection screen.

Next, FIGS. 9A to 9H are used while the image formation operation at the time of selecting the post-processing mode is described. Here, the conveying motor control at the time of a buffer operation using the two-sided conveying path 145 is described.

As the first embodiment, a description is given to an image forming apparatus which has the sheet conveying speeds of about 100 mm/sec at the photosensitive drum 115 and the fixing unit 121 of the image forming unit and can perform the image formation of 14 sheets in the size of A4 paper per minute. In this case, the discharge interval of sheets is about 428 mm, and an interval between sheets is about 218 mm. In the following, a case where three pages of originals receive stapling processing is described.

First, in the case where the staple sort mode is selected in the screen of FIG. 8B, the printer control unit 180 and the finisher control unit 580 synchronize with each other while the whole image forming apparatus performs the stapling processing operation in conformity with the instructions of the CPU circuit unit 150.

The printer control unit 180 determines whether the buffer operation, which will be described in the following, is performed or not according to a designated mode. In the first embodiment, the following processing is performed in the case where the designated mode is performing finisher processing, the number of copies is two or more, and the image formation is performed on one face.

First, as for a fist bundle, the processing similar to the above-mentioned one face operation is performed. That is to say, a developer image formed on the photosensitive drum 115 is transferred to a sheet fed from each of the cassettes 101*a* to 101*d* or the manually paper feeding tray 105 by being guided by the conveying path 147 by the transferring unit 118. Then, the sheet having passed through the fixing unit 121 is guided to the conveying path 142 by the flapper 133, and is discharged to the outside (finisher 500) out of the printer 100 through the discharge rollers 111 (see FIG. 9A). Similarly, image formation is performed also on the sheets of a second page and a third page, and the sheets are discharged into the finisher 500 (see FIG. 9B).

When three pages of sheets to be bundle and stapled have been discharged onto the above-mentioned intermediate processing tray (the bundled sheet discharging belt 503), the aligning operation of the sheets is performed by the aligning plates 506. After that, a stapler 505 is driven to perform a stapling operation, and the stapled bundle of sheets is discharged onto the stack tray 507 by the bundled sheet discharging belt 503.

In this case, when a succeeding sheet is discharged into the finisher 500 while the first bundle is adjusted to receive the stapling operation after the third page of the sheets has been discharged into the finisher 500 (see FIG. 9B), there is produced a problem such that the stapling operation of the first bundle is not performed normally, or that the succeeding sheet is also stapled at the same time. Consequently, the succeeding sheet is not discharged into the finisher 500 until the stapling processing of the first bundle has been completed to be discharged onto the stack tray 507.

Figure 9B:
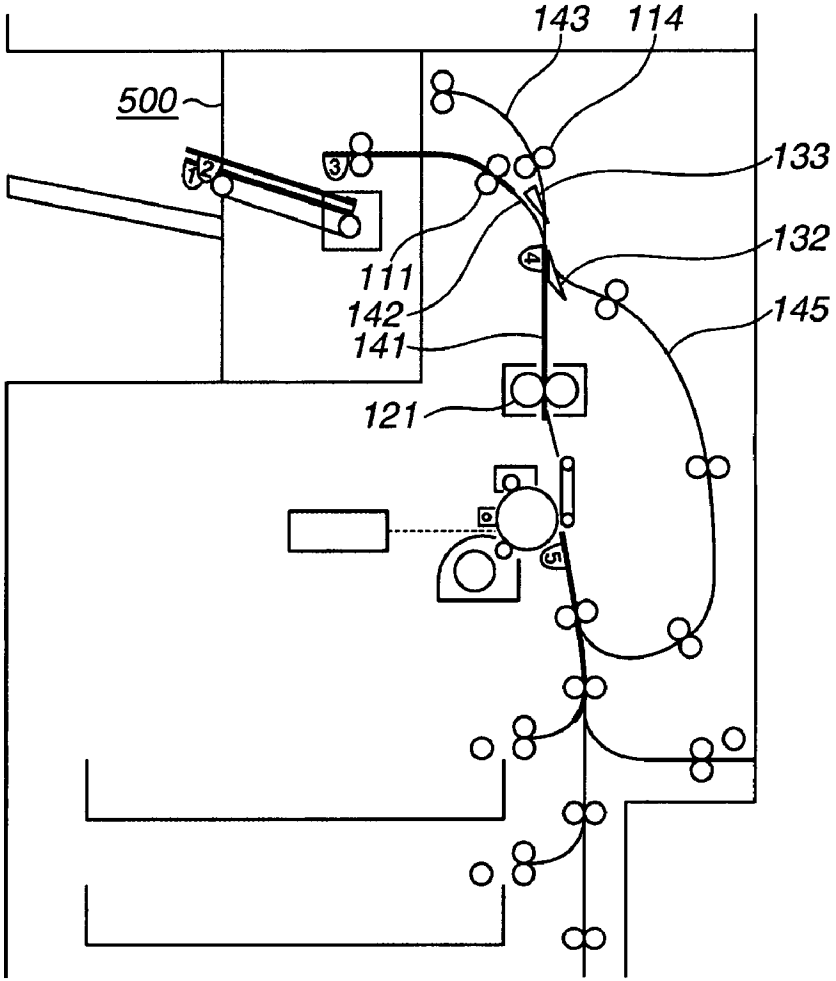
FIGS. 9A, 9B, 9C, 9D, 9E, 9F, 9G and 9H are explanatory views showing an image formation operation at the time of the selection of the post-processing mode of the image forming apparatus according to the first embodiment.
Figure 9A:
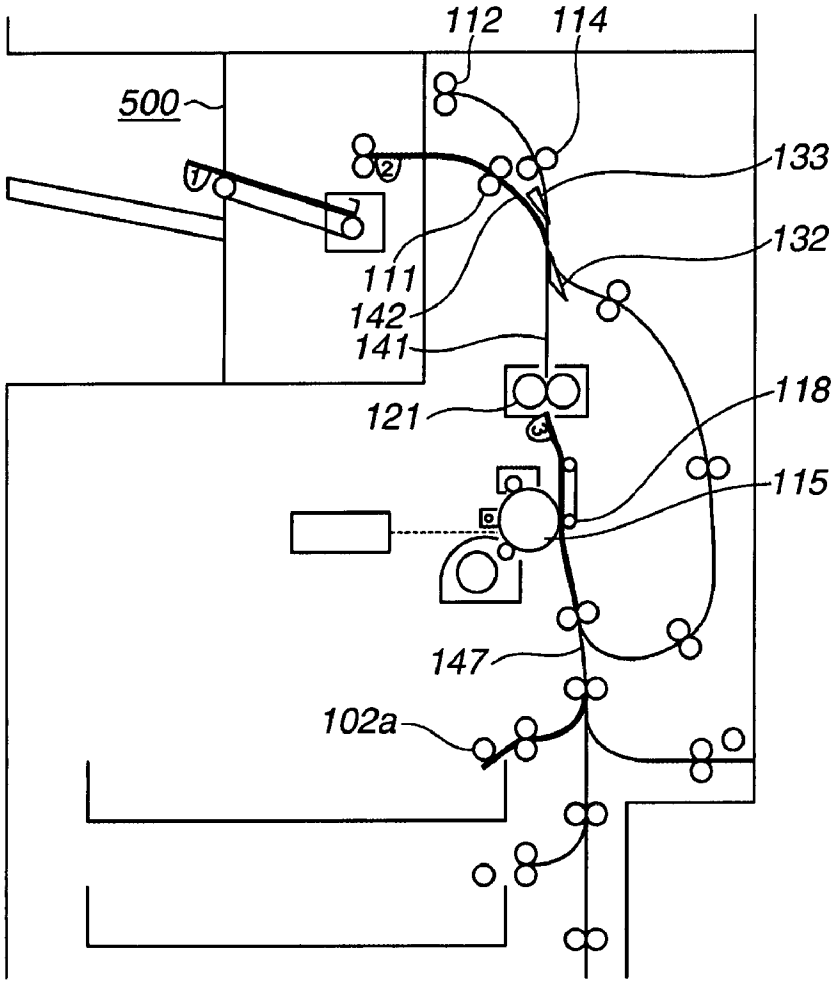
Figure 9D:
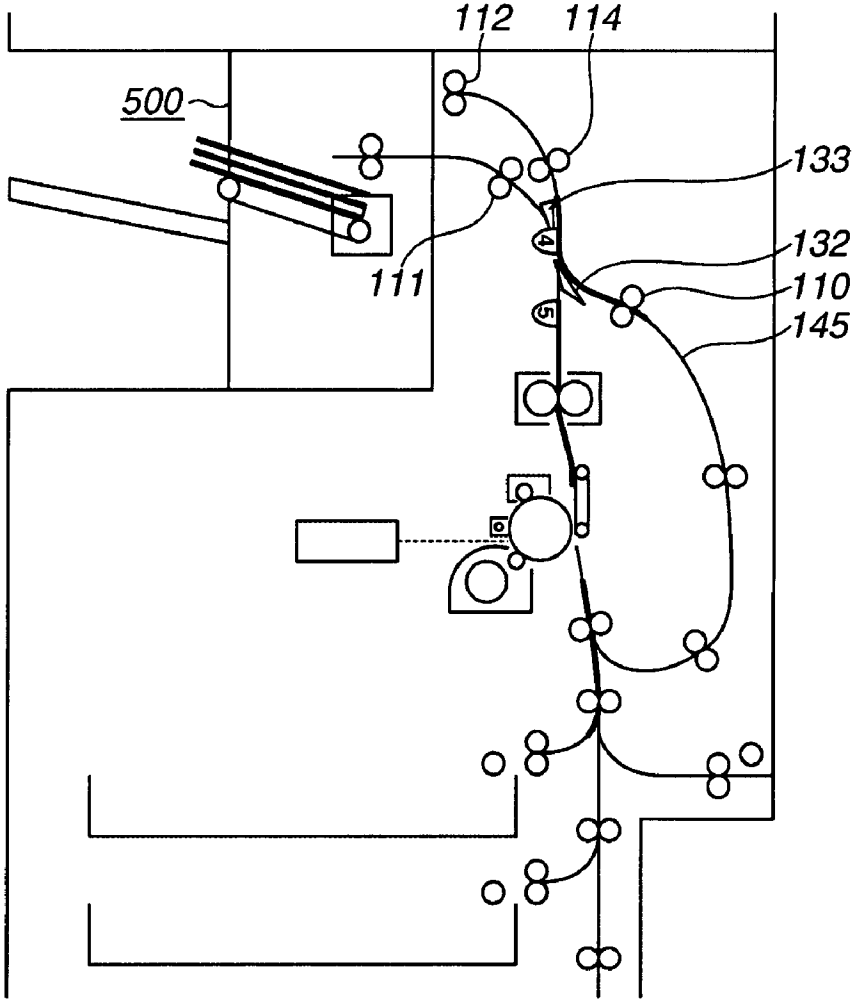
Figure 9C:
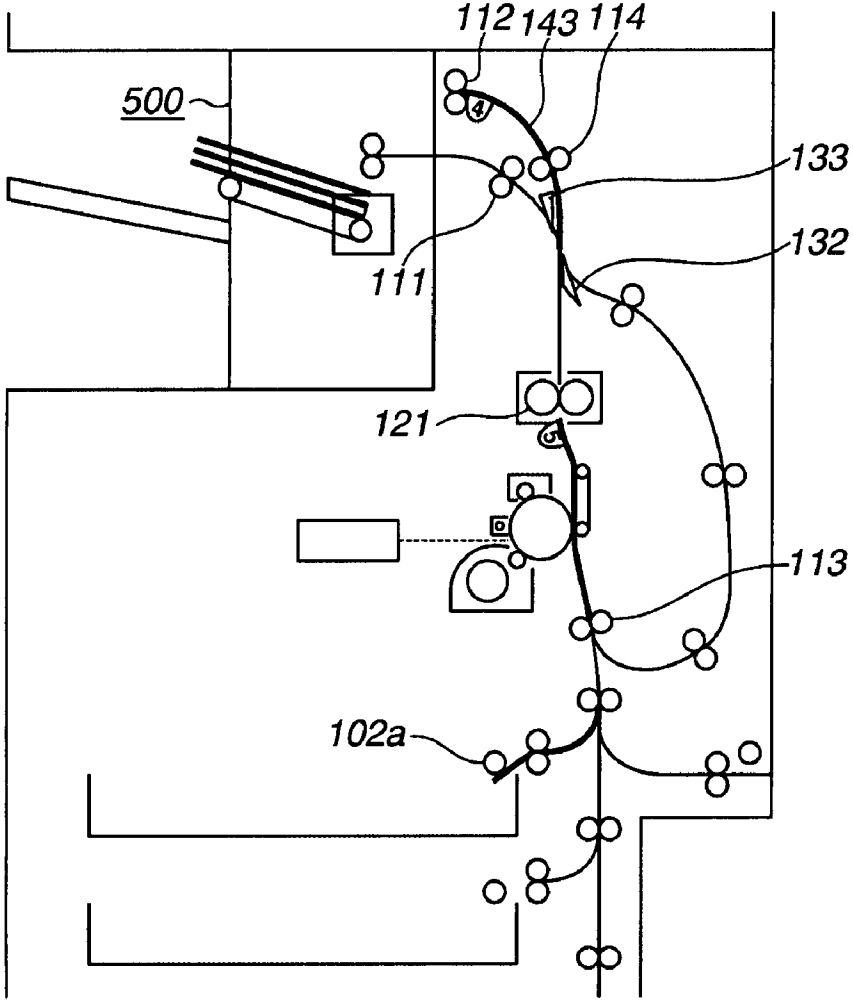

Accordingly, as shown in FIG. 9C, the flapper 133 is switched to convey a fourth page of the sheets into the conveying path 143. In this case, it is necessary to convey the fourth page of the sheets into the two-sided conveying path 145 after having been switched back in the conveying path 143 by the time when the succeeding fifth page is discharged (in a time between the sheets of the fourth page and the fifth page). Accordingly, the flapper 132 is switched into the direction to convey a sheet into the two-sided conveying path 145 at the timing when the trailing edge of the sheet of the fourth page passes through the flapper 132 after the fourth page having been conveyed into the conveying path 143, and at the same time the conveying rollers 112 and 114 rotate in reverse to convey the sheet into the two-sided conveying path 145 (see FIG. 9D).

Figure 9F:
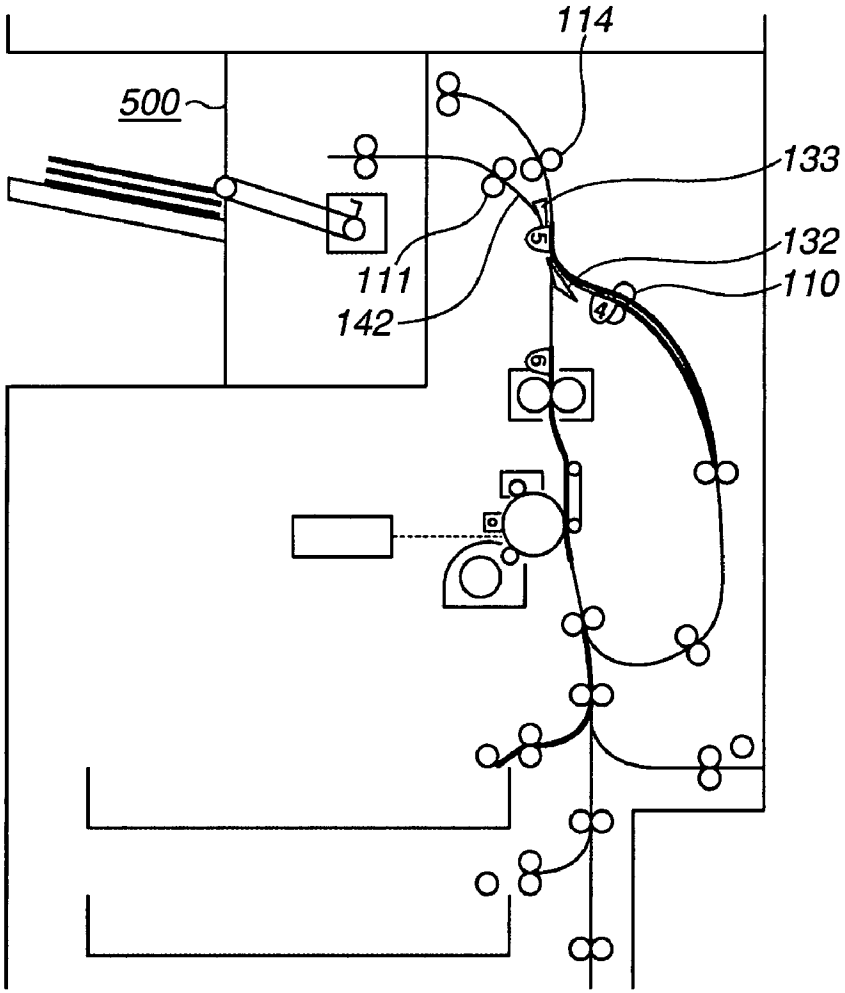
Figure 9E:
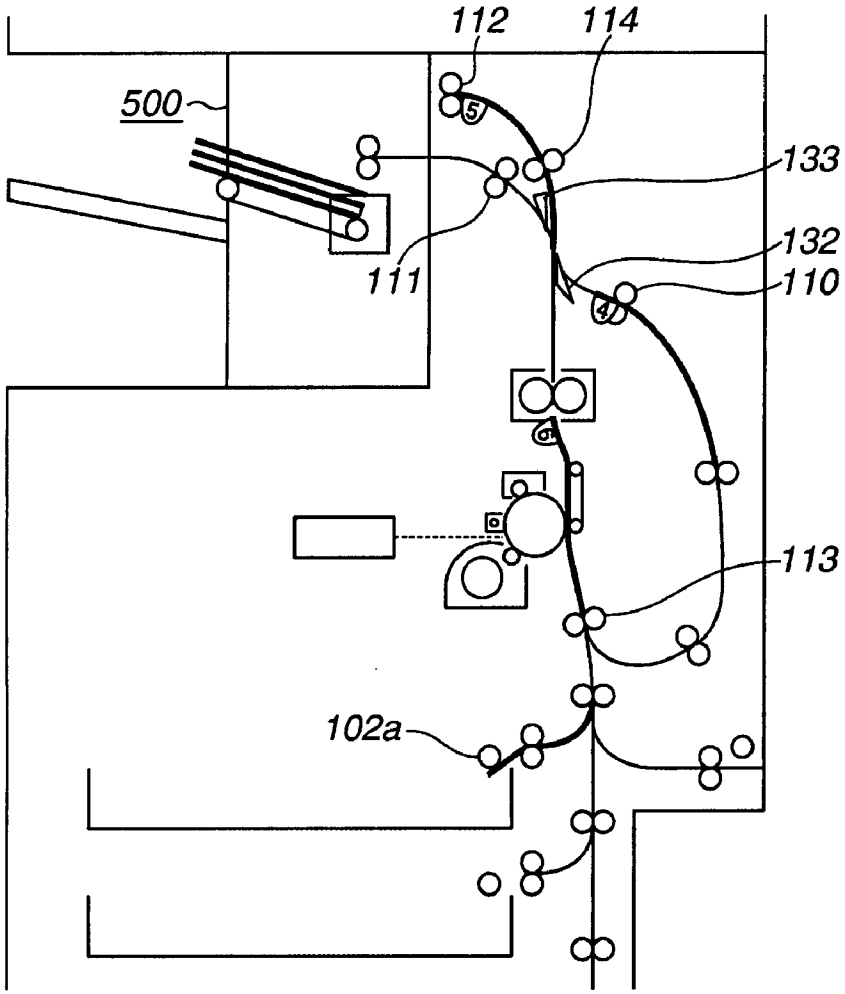

Next, as shown in FIG. 9E, at a point of time when the fourth page of the sheets has reached a predetermined position in the two-sided conveying path 145, conveying rollers 110 stop rotating. On the other hand, the succeeding fifth page of the sheets is conveyed to the conveying path 143 similarly to the fourth page of the sheets. Now, it is needed to convey the fifth page of the sheets into the two-sided conveying path 145 to be discharged into the finisher 500 in the state of being put together with the fourth page (being put upon the fourth page) after having been switched back in the conveying path 143 by the time when the succeeding sixth page is discharged (in a time between the sheets of the fifth page and the sixth page).

Accordingly, similarly to the fourth page of the sheets, the flapper 132 is switched into the direction to convey a sheet into the two-sided conveying path 145 at the timing when the trailing edge of the sheet passes through the flapper 132, and the conveying rollers 112 and 114 rotate in reverse to convey the sheet into the two-sided conveying path 145 (see FIG. 9E).

Now, the movements of the sheets in the two-sided conveying path 145 are described in detail. FIGS. 10A to 10E are views showing the operation of the two-sided conveying path unit.

Figure 10A:
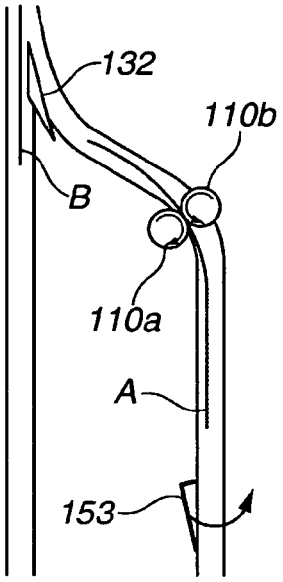
FIGS. 10A, 10B, 10C, 10D and 10E are explanatory views showing the operation of a two-sided conveying path unit at the time of the selection of the post-processing mode of the image forming apparatus according to the first embodiment.

FIG. 10A shows the operation of a sheet in the two-sided conveying path 145 shown in FIGS. 9D to 9E. After a sheet A has been conveyed into the two-sided conveying path 145, the flapper 132 is switched for conveying the succeeding sheet B into the conveying path 143. Conveying rollers 110*a* and 110*b* rotate into a direction to send the sheet A into the inside of the two-sided conveying path 145. Moreover, a movable stopper 153, which is housed in the wall of the conveying path at the time of a two-sided operation, moves to a position where the movable stopper 153 supports the front edge of the sheet in the direction of movement according to the size of the sheet A.

Figure 10B:
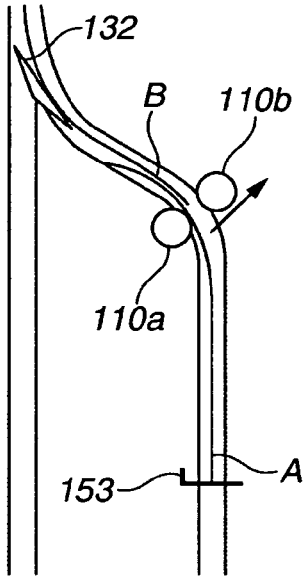
Figure 10C:
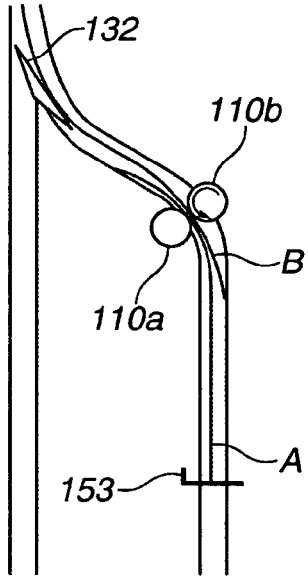
Figure 10D:
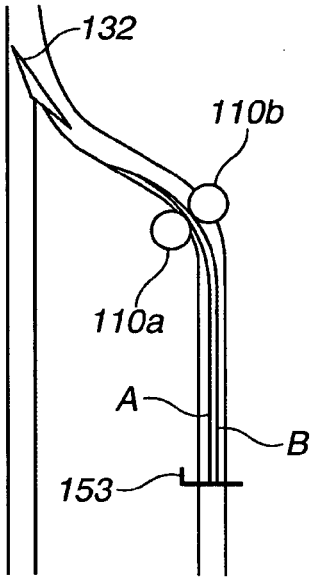
Figure 10E:
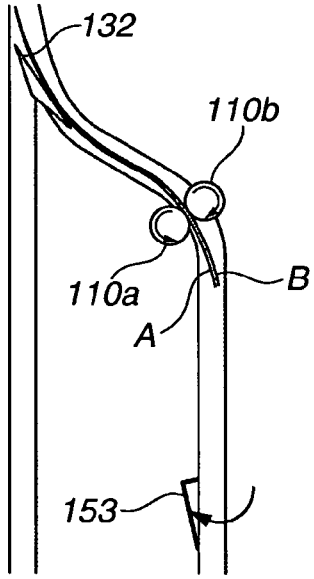

FIG. 10B shows the operations of sheets in the two-sided conveying path 145 in the state of FIG. 9F. The sheet A is in a state of being housed in the two-sided conveying path 145, and is supported by the movable stopper 153. Consequently, the sheet A is in the state of not falling downward in the two-sided conveying path 145. The flapper 132 is switched so as to convey the succeeding sheet B into the two-sided conveying path 145. The conveying rollers 110*a* and 110*b* stop rotating so as not to convey the sheet A, and the conveying roller 110*b* is separated from the conveying roller 110*a* so as to put the sheet B between them.

Next, at the point of time when the front edge of the sheet B has passed through the position between the conveying rollers 110*a* and 110*b*, the conveying roller 110*b* is joined with the conveying roller 110*a*. After that, only the conveying roller 110*b* is rotated into the direction to send the sheet B into the inside of the two-sided conveying path 145 while the conveying roller 110*a* remains stopped in order that the sheet A is not be conveyed and only the sheet B is be conveyed in the two-sided conveying path 145 (see FIG. 10C). When the front edge of the sheet B is conveyed to a position where the front edge comes in contact with the movable stopper 153, the conveying roller 110*b* stops rotating (see FIGS. 9G and 10D).

On the other hand, at this point of time, the stapling processing of the first bundle in the finisher 500 is completed, and the first bundle is discharged onto the stack tray 507. Both the fourth page and the fifth page of the sheets waiting in the two-sided conveying path 145 are simultaneously conveyed from the two-sided conveying path 145 to the conveying path 142 at a point of time when a predetermined time has passed from the start of the stapling of the first bundle, and both the pages are discharged onto the finisher 500. At this time, both the conveying rollers 110*a* and 110*b* are rotated to convey both pages, put one upon another together, from the two-sided conveying path 145 to the conveying path 142 (see FIG. 10E).

In this case, if the fourth and the fifth pages of the sheets are conveyed at a normal speed, the fourth and the fifth pages of the sheets cannot be discharged into the finisher 500 by the time when the sixth page of the sheets is conveyed into the conveying path 142. Accordingly, when the fourth and the fifth pages of the sheets are conveyed from the two-sided conveying path 145 to the conveying path 142, the conveying rollers 110*a* and 110*b* are rotated at a higher speed to discharge the pages. In the first embodiment, the conveying rollers 110*a* and 110*b* are adapted to rotate at a speed being twice as fast as the conveying speed of the fixing unit 121 to convey the pages.

Figure 9H:
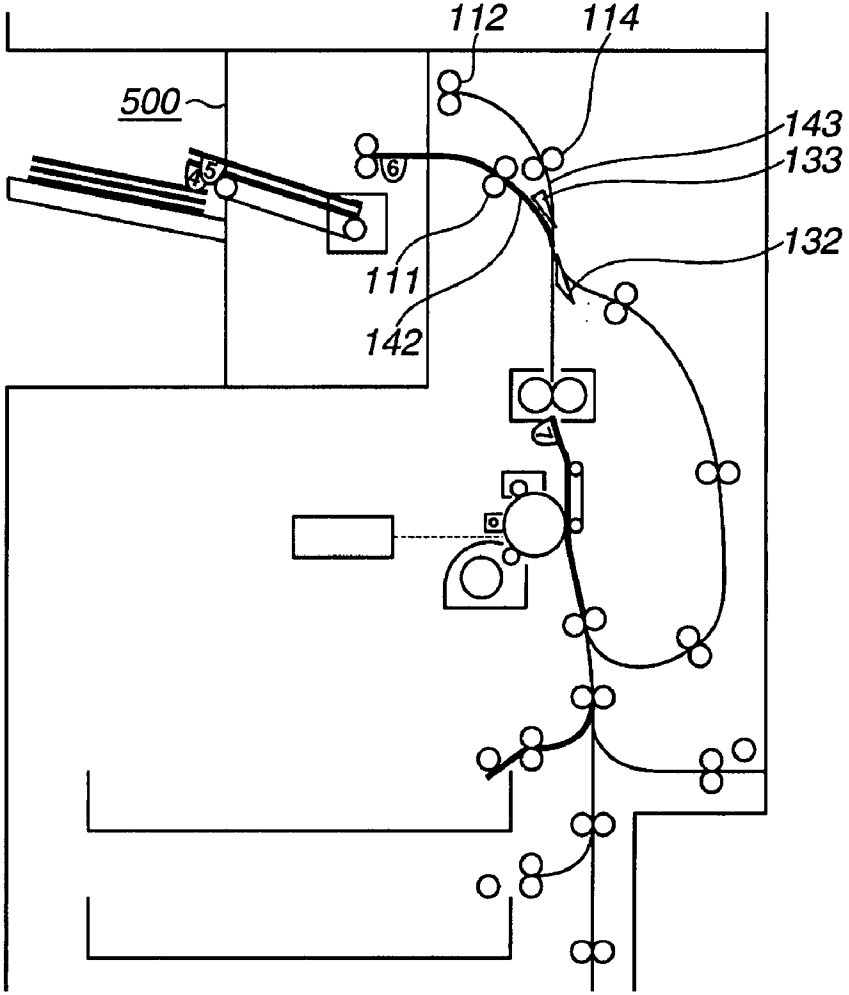
Figure 9G:
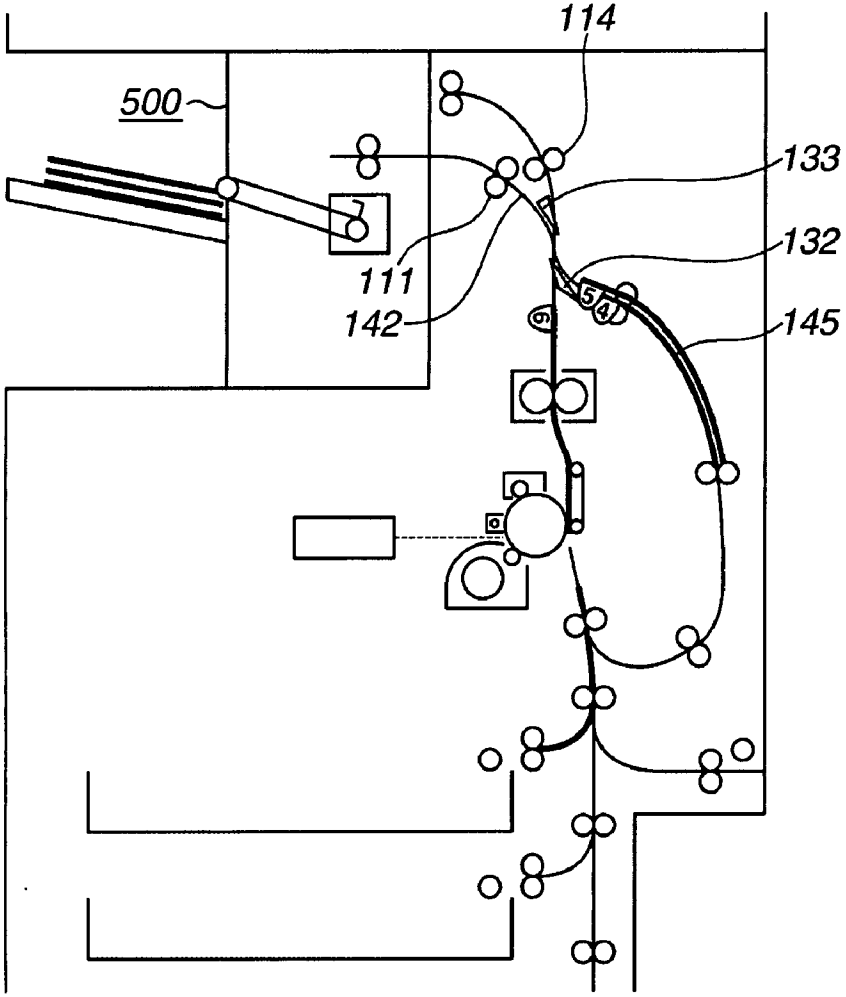

After the succeeding sixth page of the sheets has passed through the fixing unit 121, the sixth page is guided to the conveying path 142 by the flapper 133, and is discharged from the printer 100 to the finisher 500 through the discharge rollers 111 at a uniform speed (see FIG. 9H). At the point of time when the sixth page has been discharged, three pages of the sheets to be bundled and stapled have been discharged on the intermediate processing tray. Consequently, after an aligning operation of the sheets has been performed by the aligning plates 506, the stapler 505 is driven to perform a stapling operation. Then, the stapled sheets are discharged onto the stack tray 507 by the bundled sheet discharging belt 503.

On and after that, the movement of every sheet at a seventh, an eighth and a ninth page in a third bundle is similar to that of every sheet at the fourth, the fifth and the sixth page as shown in FIG. 9B.

As described above, by discharging the sheets retained in the two-sided conveying path 145 at a higher speed, the sheets can be discharged onto the intermediate processing tray while maintaining the page numbers without colliding with the succeeding sheet.

Second Embodiment

In the second embodiment, the description is given to the image forming apparatus which has the sheet conveying speed of the image forming unit of about 110 mm/sec and can perform the image formation of 21 sheets in the size of A4 paper per minute. In this case, the discharge interval of sheets is about 314 mm, and an interval between sheets is about 104 mm. In the following, similarly to the first embodiment, a case where three pages of originals receive stapling processing is described.

As for a fist bundle, the processing similar to that of the above-mentioned first embodiment is performed. As for the fourth page of the sheets, similarly as shown in FIG. 9C, the flapper 133 is switched to convey the fourth page into the conveying path 143. In this case, it is necessary to convey the fourth page of the sheets into the two-sided conveying path 145 after having been switched back in the conveying path 143 by the time when the succeeding fifth page of the sheets is discharged (in a time between the sheets of the fourth page and the fifth page). Accordingly, the conveying rollers 112 and 114 begin to increase their rotation speeds at the timing when the fourth page of the sheets passes through the fixing unit 121 to convey the sheet. In the second embodiment, the conveying rollers 112 and 114 increase their speeds to be twice as fast as the conveying speed of the fixing unit 121.

After that, the flapper 132 is switched into the direction of conveying a sheet into the two-sided conveying path 145 at the timing when the front edge of the sheet reaches the flapper 132, and the conveying rollers 112 and 114 rotate in reverse to convey the sheet into the two-sided conveying path 145 (see FIG. 9D). At this time, the conveying rollers 110 rotate at a double-speed similar to the conveying rollers 112 and 114. On the other hand, as described above with reference to FIGS. 5A to 5G, in the case where the two-sided conveying path 145 is used for two-sided image formation, the conveying rollers 110 perform conveyance at a speed equal to the conveying speed of the fixing unit 121.

Next, as shown in FIG. 9E, at a point of time when the fourth page of the sheets has reached a predetermined position in the two-sided conveying path 145, the conveying rollers 110 stop rotating. On the other hand, the succeeding fifth page of the sheets is conveyed to the conveying path 143 similar to the fourth page of the sheets. Now, it is needed to convey the fifth page of the sheets into the two-sided conveying path 145 to be discharged into the finisher 500 in the state of being put on together with the fourth page after having been switched back in the conveying path 143 by the time when the succeeding sixth page is conveyed into the conveying path 142 (in a time between the sheets of the fifth page and the sixth page). Accordingly, the conveying rollers 112 and 114 begin to increase their speeds at the timing when the fifth page of the sheets has passed through the fixing unit 121 to convey the sheet. In the second embodiment, the conveying rollers 112 and 114 increase their speeds up to four times as fast as the conveying speed of the fixing unit 121.

After that, as for the fifth page of the sheets, similar to the fourth page of the sheets, the flapper 132 is switched into the direction to convey the sheet into the two-sided conveying path 145 at the timing when the front edge of the sheet reaches the flapper 132, and the conveying rollers 112 and 114 rotate in reverse to convey the sheet into the two-sided conveying path 145 (see FIG. 9F). At this time, the conveying rollers 110 are rotating at a quad-speed similar to the conveying rollers 112 and 114. On the other hand, at this point of time, the stapling processing of the first bundle in the finisher 500 has been completed, and the first bundle is discharged onto the stack tray 507.

After that, both the fourth page and the fifth page of the sheets waiting in the two-sided conveying path 145 (see FIG. 9G) are conveyed from the two-sided conveying path 145 to the conveying path 142 in the state in which one of them is put upon the other at a point of time when a predetermined time has passed from the start of the stapling of the first bundle, and both the pages are discharged into the finisher 500. In this case, the conveying rollers 110 and 111 are rotating at a quad-speed.

After the succeeding sixth page of the sheets has passed through the fixing unit 121, the sixth page is guided into the conveying path 142 by the flapper 133, and is discharged from the printer 100 to the finisher 500 through the discharge rollers 111 at a uniform speed (see FIG. 9H). At the point of time when the sixth page has been discharged, three pages of the sheets for a bundle to be stapled have been discharged on the intermediate processing tray. Consequently, after an aligning operation of the sheets is performed by the aligning plates 506, the stapler 505 is driven to perform a stapling operation. Then, the stapled sheets are discharged onto the stack tray 507 by the bundled sheet discharging belt 503.

On and after that, the movement of every sheet at a seventh page, at an eighth page and at a ninth page in a third bundle is similar to that of every sheet at the fourth page, at the fifth page and at the sixth page.

Third Embodiment

As a third embodiment of the present invention, an image forming apparatus having a narrow sheet interval is described. In this case, the discharge of the fourth page and the fifth page of the sheets, which have been retracted into the two-sided conveying path 145, to the finisher 500 can be too late for the discharge of the sixth page of the sheets in the above-mentioned operation. A method for performing stapling processing without widening the time between the fifth sheet and the sixth sheet by changing the order of image formation in such a case is described with reference to FIGS. 11A to 11H.

In the case where the staple sort mode is selected in the screen of FIG. 8B, the printer control unit 180 and the finisher control unit 580 synchronize with each other while the whole image forming apparatus performs the stapling processing operation in conformity with the instructions of the CPU circuit unit 150.

The printer control unit 180 determines whether the buffer operation (retaining processing), which will be described in the following, is performed or not according to a designated mode. In the third embodiment, the following processing is performed in the case where the designated mode is performing the finisher processing, the number of printed copies is two or more, and the image formation is performed on one face of a sheet.

First, as for a fist bundle, the processing similar to that of the above-mentioned first embodiment and the second embodiment is performed. As for a second bundle, in the case where the printer control unit 180 determines that a buffer operation is needed, fist, the image formation of a fifth page is performed and then the image formation of a sixth page is performed as to the image data which have been sent from the image reader 200 or the computer 283 to be stored in the memory, and the sheets having received the image formation are conveyed (see FIG. 11B). Incidentally, the numerals attached to the sheets in FIG. 11A to 11H denote the order of image pages and are different from the order of the paper conveyance.

Figure 11B:
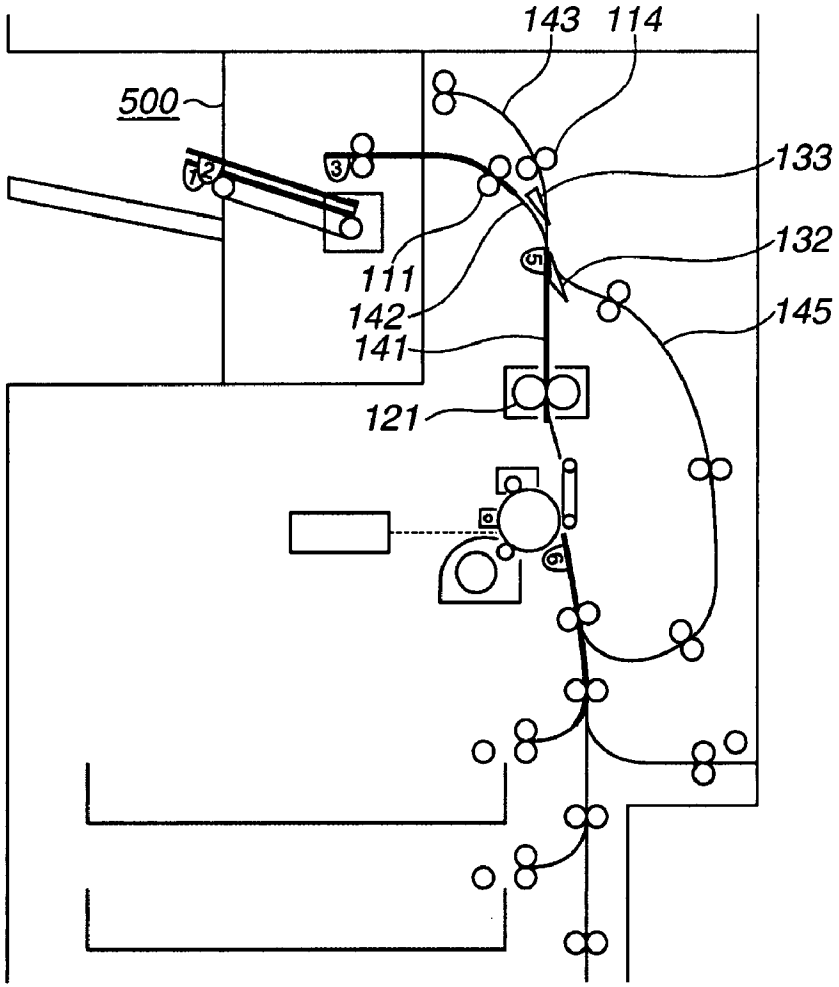
FIGS. 11A, 11B, 11C, 11D, 11E, 11F, 11G and 11H are explanatory views showing an image formation operation at the time of the selection of the post-processing mode of an image forming apparatus according to a third embodiment of the present invention.
Figure 11A:
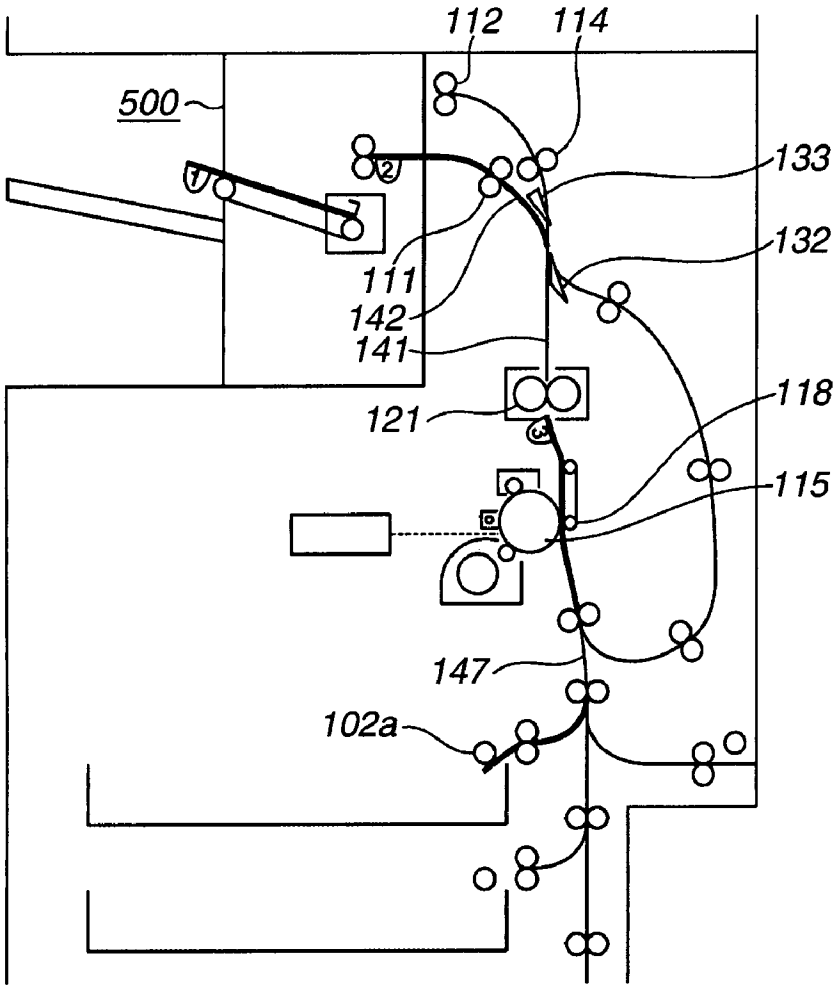
Figure 11D:
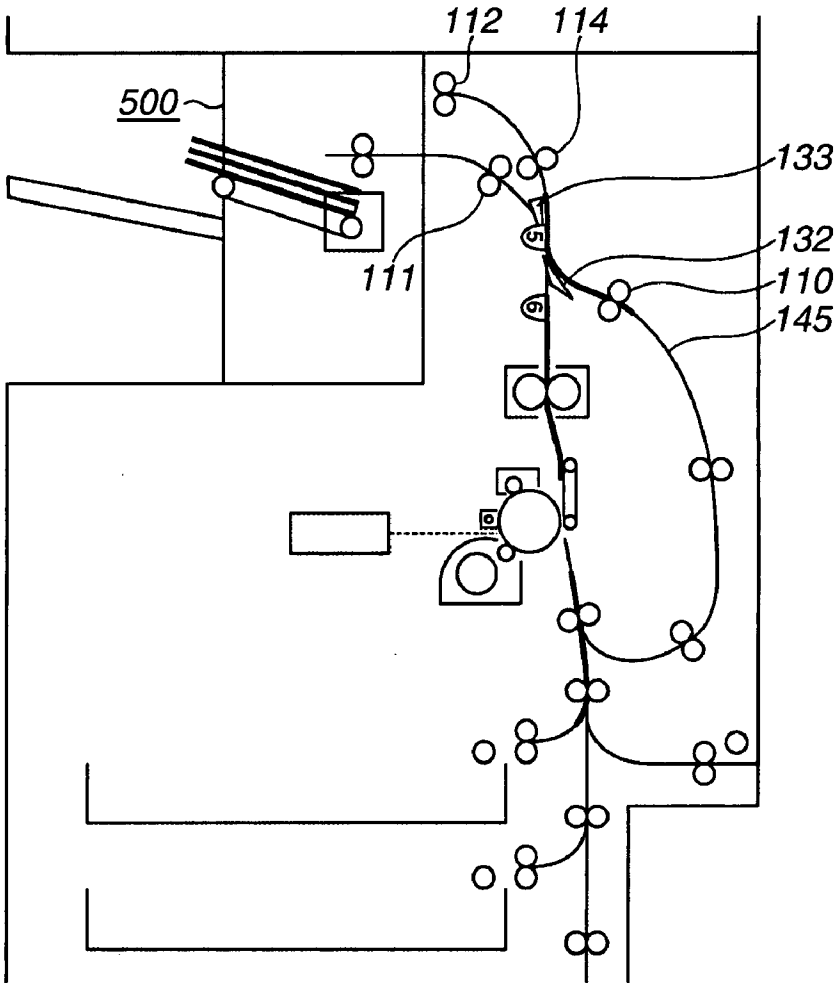
Figure 11C:
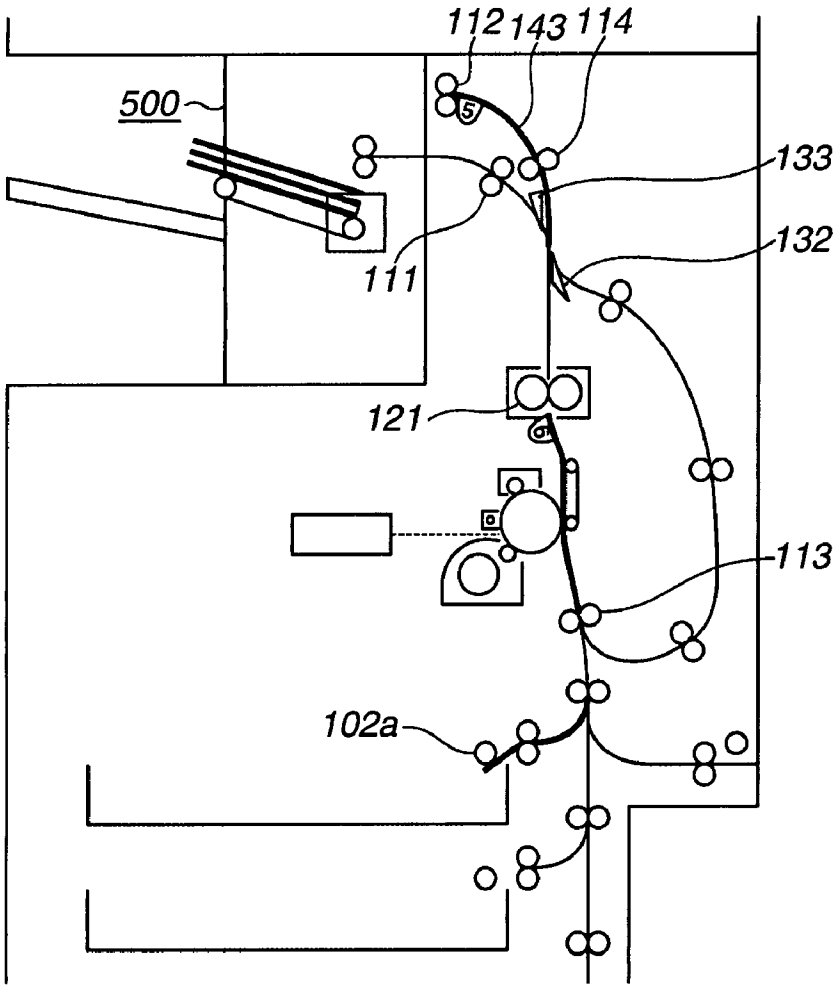

When a fifth page of the sheets is conveyed, as shown in FIG. 11C, the flapper 133 is switched to convey the fifth page of the sheets into the conveying path 143. In this case, it is necessary to convey the fifth page of the sheets into the two-sided conveying path 145 after having been switched back in the conveying path 143 by the time when the succeeding sixth page is conveyed to the conveying path 141 (to the position of the flapper 132) (in a time between the sheets of the fifth page and the sixth page). Accordingly, the conveying rollers 112 and 114 begin to increase their speeds to convey the sheet at the timing when the fourth page has passed through the fixing unit 121. In the third embodiment, the conveying rollers 112 and 114 increase their speeds to be twice as fast as the conveying speed of the fixing unit 121.

After that, at the timing when the front edge of the sheet reaches the flapper 132, the flapper 132 is switched into the direction to convey the sheet to the two-sided conveying path 145, and the conveying rollers 112 and 114 rotate in reverse to convey the sheet into the two-sided conveying path 145 (see FIG. 11D). At this time, the conveying rollers 110 are rotating at a double-speed similar to the conveying rollers 112 and 114.

Figure 11F:
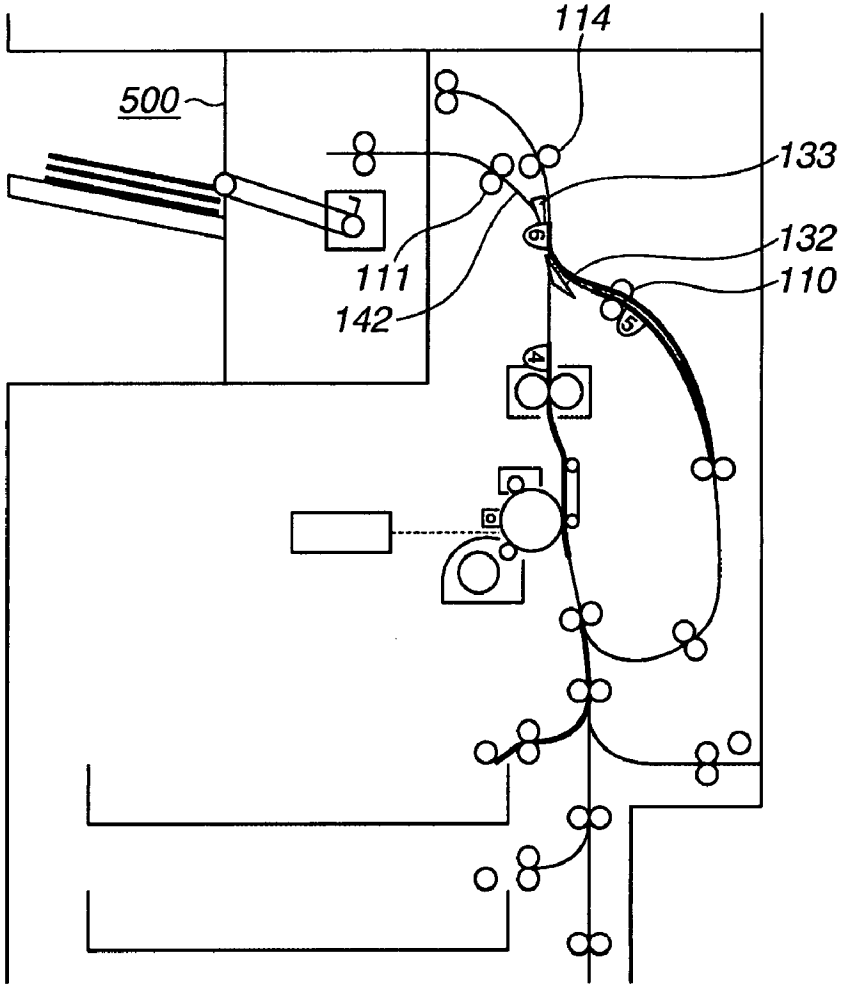
Figure 11E:
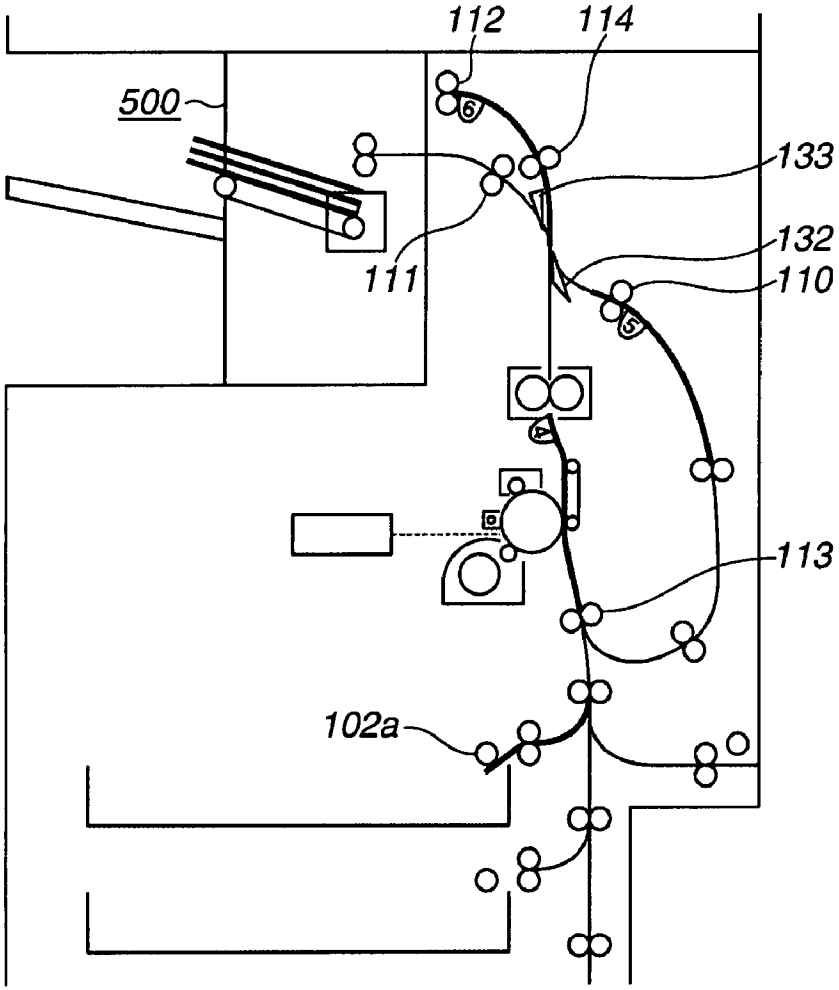

Next, as shown in FIG. 11E, at the point of time when the fifth page of the sheets has reached the predetermined position in the two-sided conveying path 145, the conveying rollers 110 stop rotating. On the other hand, the succeeding sixth page of the sheets is conveyed into the conveying path 143 similar to the fifth page of the sheets. Now, it is necessary to convey the sixth page of the sheets into the two-sided conveying path 145 after having been switched back in the conveying path 143 by the time when the succeeding fourth page of the sheets is conveyed into the conveying path 141 (in a time between the sheets of the sixth page and the fourth page). At this time, the conveying rollers 110 are rotating at a double-speed similarly as described above.

After that, as for the sixth page of the sheets, similar to the fifth page of the sheets, at the timing when the front edge of the sheet reaches the flapper 132, the flapper 132 is switched into the direction to convey the sheet into the two-sided conveying path 145, and the conveying rollers 112 and 114 convey the sheet into the two-sided conveying path 145 by returning the motor into the positive rotation thereof (see FIG. 11F). At this time, the conveying rollers 110 are rotating at a double-speed similar to the conveying rollers 112 and 114. On the other hand, at this point of time, the stapling processing of the first bundle in the finisher 500 is completed, and the first bundle is discharged onto the stack tray 507.

Figure 11H:
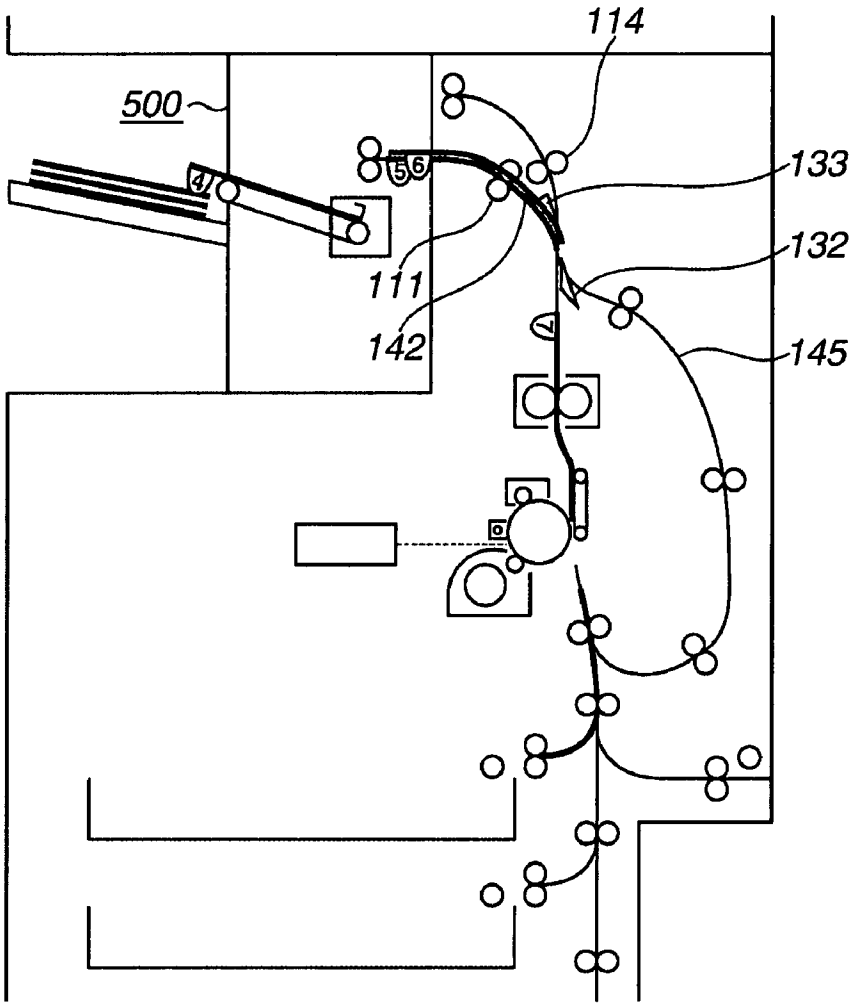
Figure 11G:
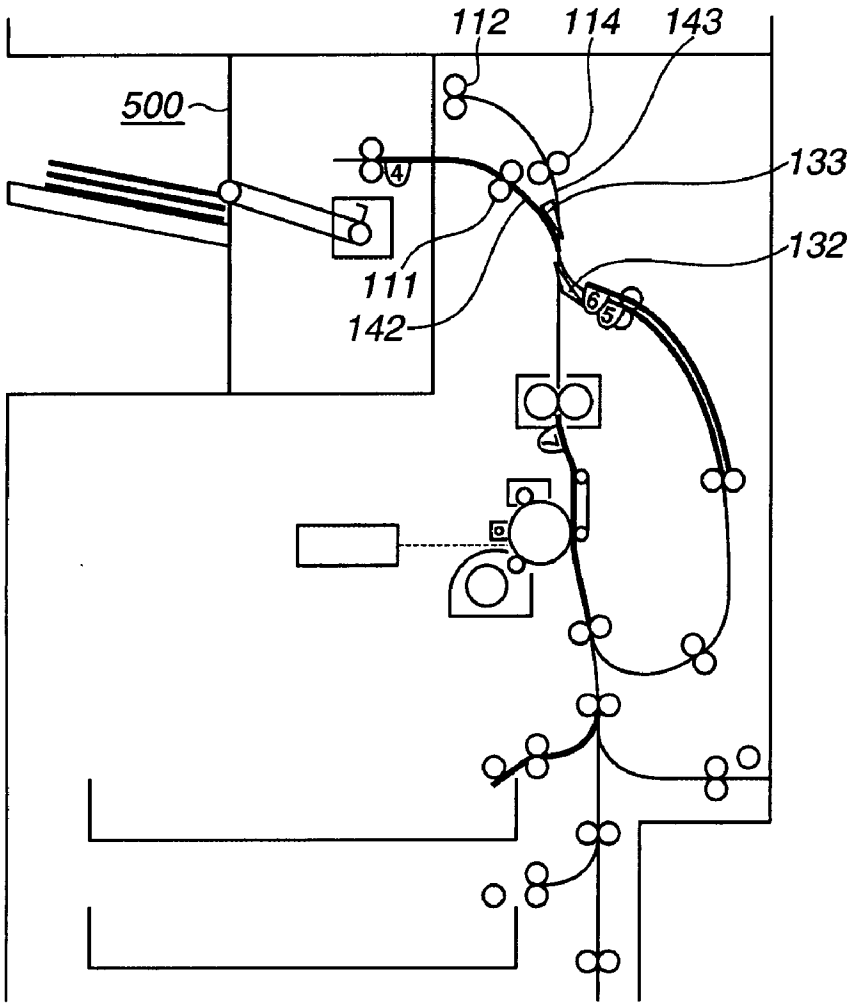

The next fourth page of the sheets begins to increase its speed at the timing of having passed through the fixing unit 121, and is guided into the conveying path 142 by the flapper 133 to be discharged from the printer 100 into the finisher 500 through the discharge rollers 111 (see FIG. 11G).

Then, successive to the fourth page of the sheets, both the fifth page of the sheets and the sixth page of the sheets waiting in the two-sided conveying path 145 are conveyed from the two-sided conveying path 145 to the conveying path 142 in the state of being one above the other (see FIG. 11H).

At the point of time when the fifth page and the sixth page of the sheets have been discharged onto the intermediate processing tray, three pages of sheets to be bundled and stapled have been discharged onto the intermediate processing tray. Consequently, after the aligning operation of the sheets has been performed by the aligning plates 506, the stapler 505 is driven to perform a stapling operation, and the stapled sheets are discharged onto the stack tray 507 by the discharged paper bundle belt 503.

On and after this, as for the movements of a seventh page, an eighth page and a ninth page of the sheets in a third bundle, the movements are similar to those of the fourth page, the fifth page and the sixth page of the sheets shown in the drawings from FIG. 11B.

Fourth Embodiment

Figure 12:
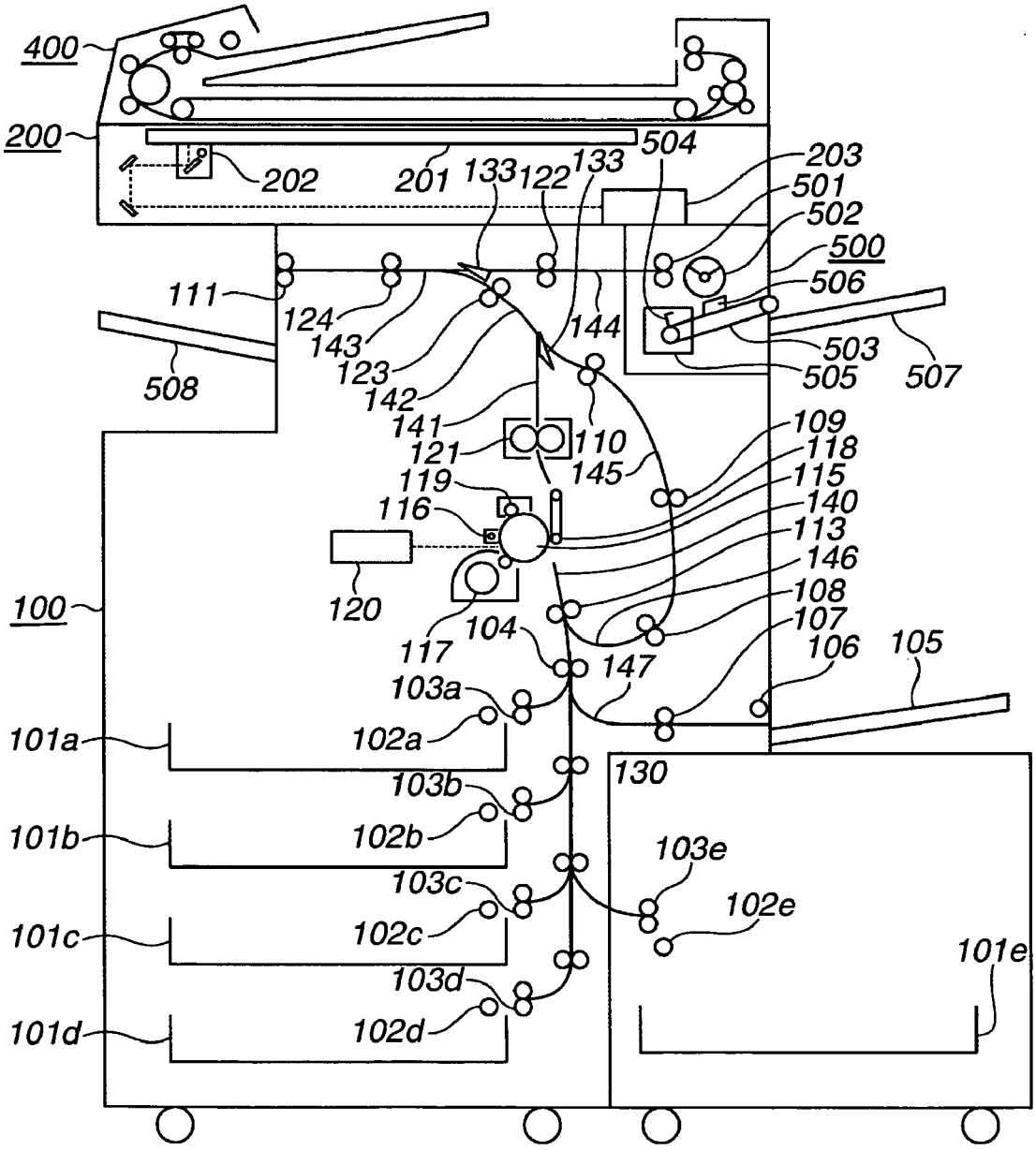
FIG. 12 is a sectional view showing the configuration of an image forming apparatus according to a fourth embodiment of the present invention.

Next, as a fourth embodiment of the present invention, an image forming apparatus shown in FIG. 12 is described. The image forming unit thereof is similar to those of the first and the second embodiments, but the configuration of the sheet discharging unit thereof is different from those of the first and the second embodiments.

First, the differences of the operation of the present embodiment from the operations of the first and the second embodiments are described. At the time of the one face operation, a sheet on which an image is formed by the photosensitive drum 115, the developing machine 117, the transferring unit 118 and the fixing unit 121 is conveyed into the conveying paths 141 and 142. Then, in the case where no post-processing is designated, the sheet is discharged onto a sheet discharging tray 508 in the state of being facedown through the conveying path 143 and the discharge rollers 111. Moreover, in the case where post-processing is designated, the sheet is conveyed into the conveying path 143. After the trailing edge of the sheet has passed the flapper 133, the flapper 133 is switched, and the sheet is conveyed to a conveying path 144 into the reverse direction. That is to say, the conveying path 143 is used as a reverse conveying path. The sheet sent to the finisher 500 through the conveying path 144 is discharged onto the bundled sheet discharging belt 503 by the discharge rollers 501. On and after this, similar to the first and the second embodiments, the post-processing is performed and the processed sheets are discharged on the stack tray 507.

Moreover, at the time of a two-sided operation, a sheet having received image formation is conveyed into the conveying path 143. After the trailing edge of the sheet has passed the flapper 132, the flapper 132 is switched to convey the sheet into the two-sided conveying path 145 in the reverse direction.

After that, the sheet again passes through the image forming unit. In the case where no post-processing is designated, the sheet is discharged into the sheet discharging tray 508. In the case where post-processing is performed, the sheet is discharged onto the stack tray 507 after the processing.

Next, the buffer control of sheets in the case where three pages of originals are copied and the copied sheets are processed to be stapled is described with reference to FIGS. 13A to 13F.

First, as for the first bundle, the processing similar to that of the above-mentioned one face operation is performed. That is to say, a developer image formed on the photosensitive drum 115 is transferred by the transferring unit 118 onto a sheet fed from each of the cassettes 101*a* to 101*d* or the manually paper feeding tray 105 by being guided by the conveying path 147. Then, the sheet having passed through the fixing unit 121 is guided into the conveying path 143 by the flapper 133. After that, the flapper 133 is switched, and the sheet is discharged from the printer 100 to the outside (finisher 500) through the conveying path 144 and the discharge rollers 501 (see FIG. 13A). Image formation is similarly performed to the second page and the third page of the sheets, and the pages are discharged into the finisher 500 (see FIGS. 13B and 13C).

When three pages of sheets to be bundled and stapled have been discharged onto the intermediate processing tray, the aligning operation of the sheets is performed by the aligning plates 506. After that, the stapler 505 is driven to perform a stapling operation, and the stapled bundle of sheets is discharged onto the stack tray 507 by the bundled sheet discharging belt 503.

Figure 13B:
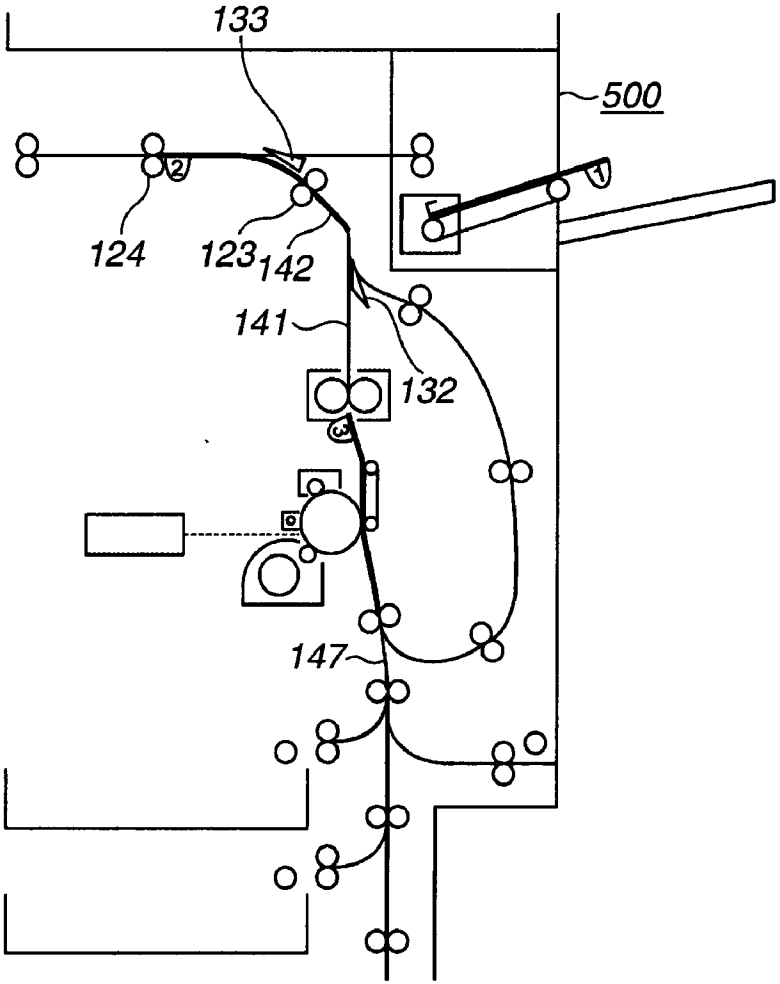
FIGS. 13A, 13B, 13C, 13D, 13E and 13F are explanatory views showing the image formation operation at the selection of the post-processing mode of the image forming apparatus according to the fourth embodiment.
Figure 13A:
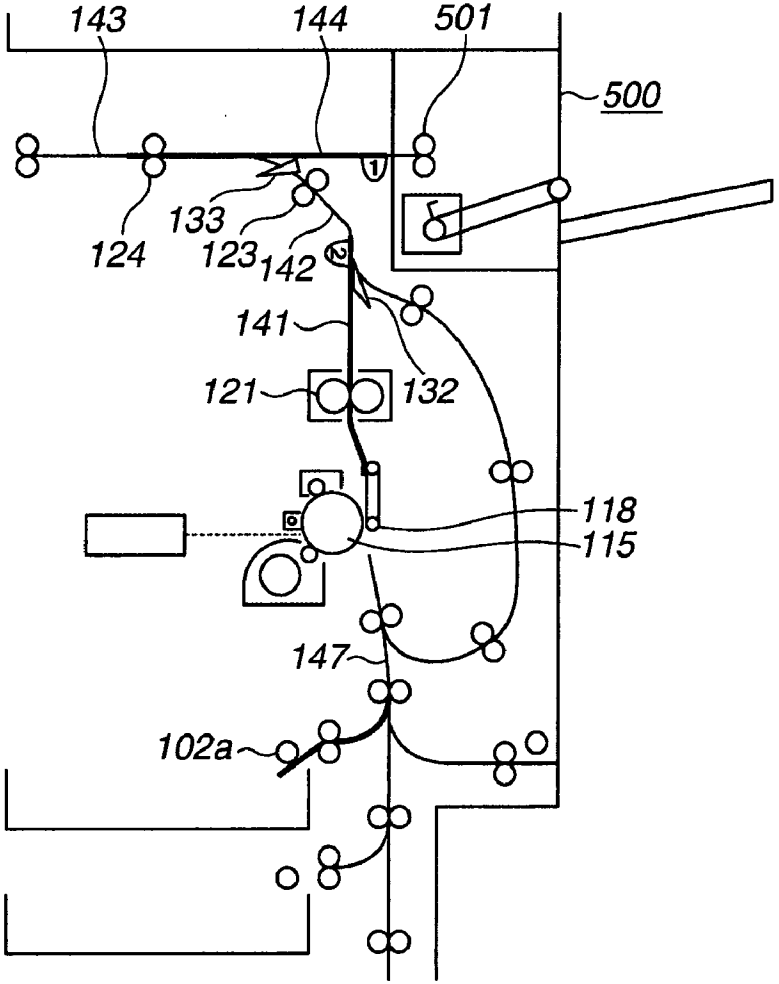
Figure 13D:
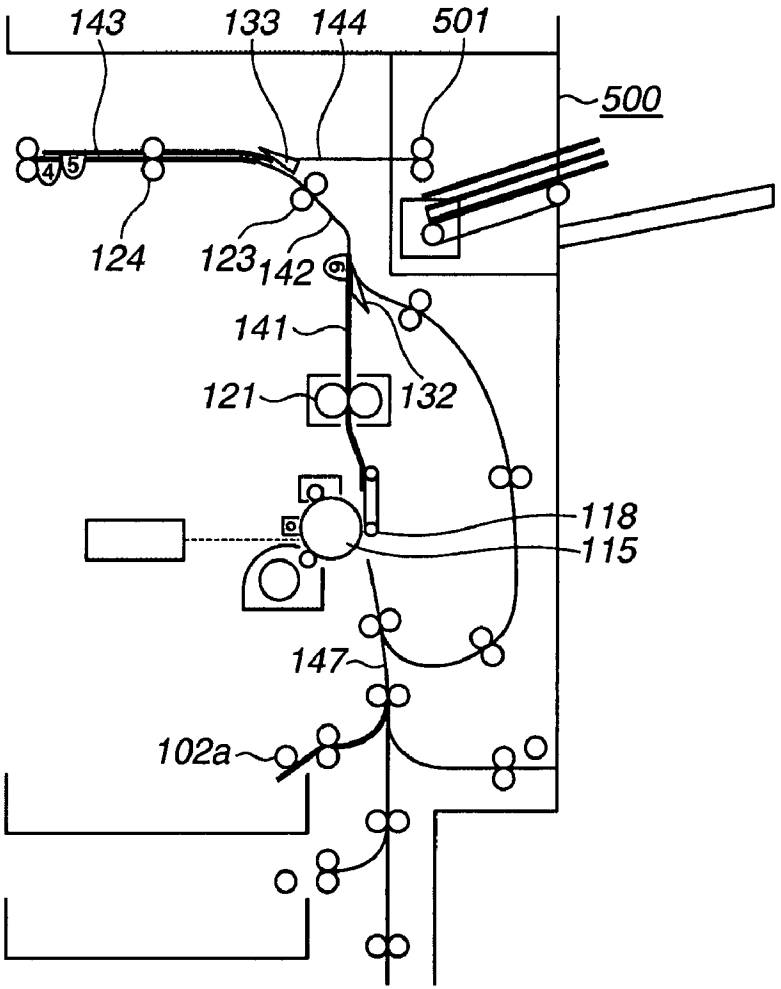
Figure 13C:
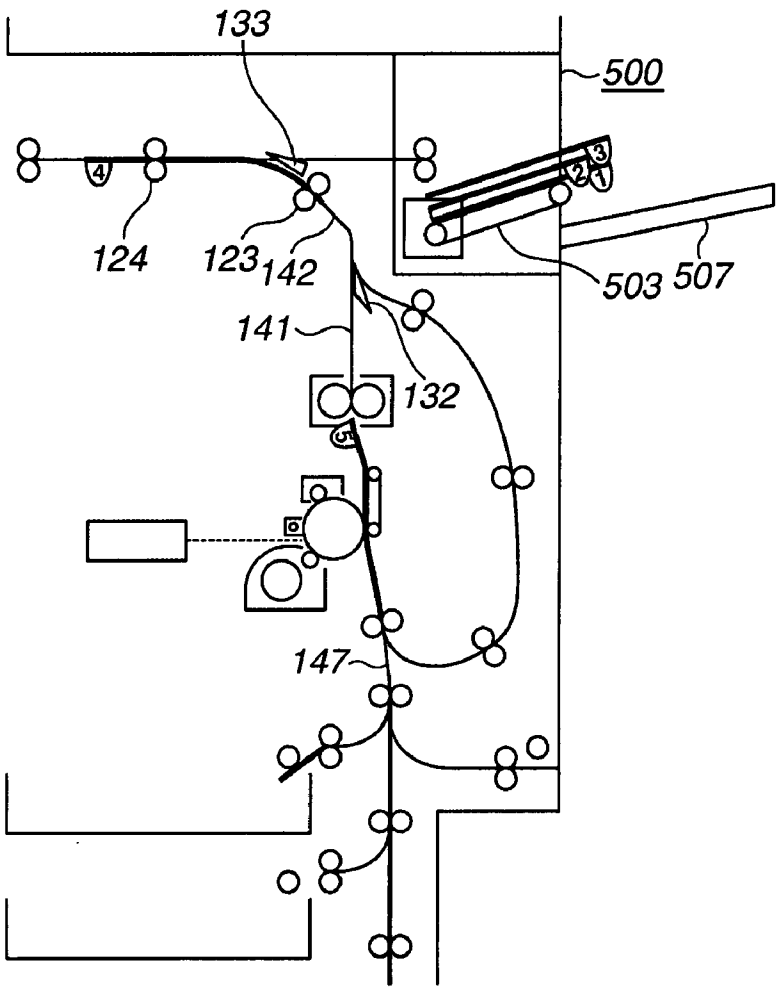

As shown in FIG. 13D, while the stapling processing of the first bundle is being performed, the sheets in the conveying path 143 are not conveyed into the finisher 500 to be retained, and the next fifth page is conveyed into the conveying path 143.

At this point of time, the stapling processing of the first bundle in the finisher 500 has been completed, and the first bundle is discharged onto the stack tray 507. Both the fourth page and the fifth page of the sheets waiting in the conveying path 143 are conveyed in the sate of being one above the other from the conveying path 143 to the conveying path 144 at a point of time when a predetermined time has passed from the start of the stapling of the first bundle, and both the pages are discharged into the finisher 500. At this time, conveying rollers 124 are rotated into the direction reverse to the direction at the time of carrying in, and thereby both the pages are simultaneously conveyed from the conveying path 143 to the conveying path 144 (see FIG. 13E).

If the fourth and the fifth pages of the sheets are conveyed at a normal speed in the case where the processing time in the finisher 500 is long, the fourth and the fifth pages of the sheets cannot be discharged into the finisher 500 by the time when the sixth page of the sheets is conveyed. Accordingly, when the fourth and the fifth pages of the sheets are conveyed from the conveying path 143 to the conveying path 144, the conveying rollers 124 are rotated at a higher speed to discharge the pages of the sheets. In the fourth embodiment, the conveyance speed of the pages is adapted to a speed being twice as fast as the conveying speed of the fixing unit.

Figure 13F:
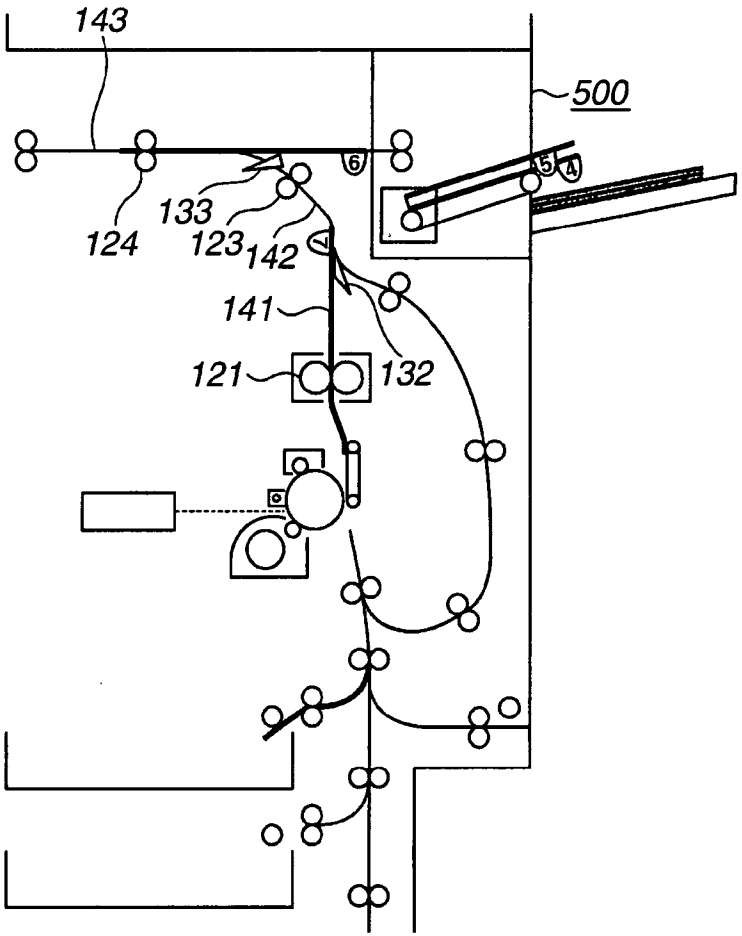
Figure 13E:
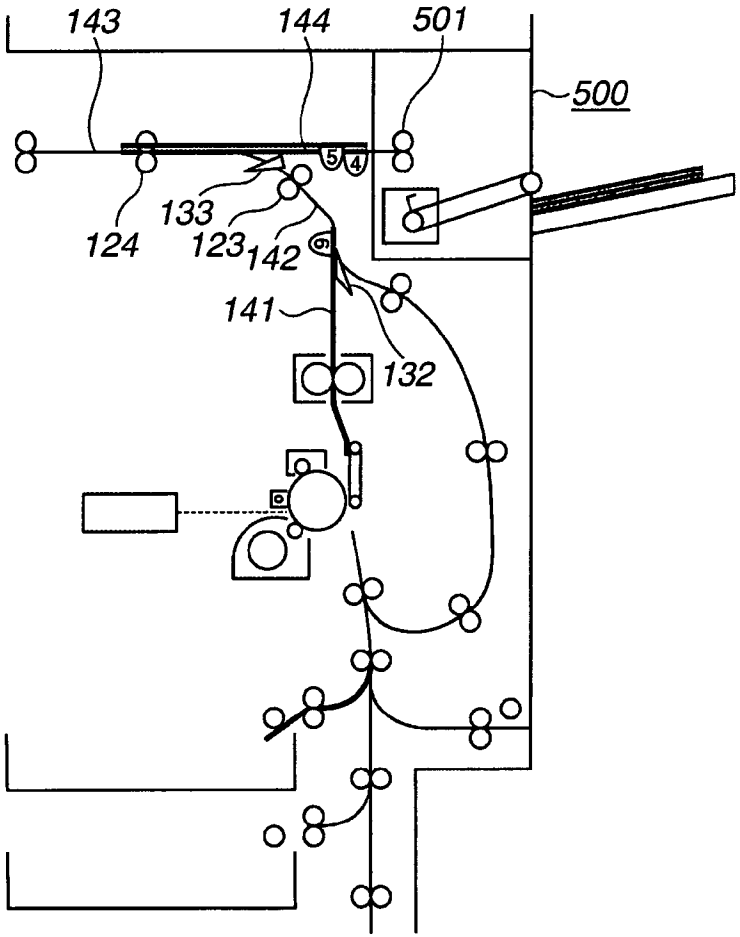

After the succeeding sixth page of the sheets has passed through the fixing unit 121, the sixth page is guided to the conveying path 143 by the flapper 133, and is switched back to be discharged from the printer 100 into the finisher 500 through the discharge rollers 501 at a uniform speed (see FIG. 13F). Then, at the point of time when the sixth page of the sheets has been discharged onto the intermediate processing tray, three pages of the sheets to be bundled and stapled have been discharged on the intermediate processing tray. Consequently, after an aligning operation of the sheets is performed by the aligning plates 506, the stapler 505 is driven to perform a stapling operation. Then, the stapled sheets are discharged onto the stack tray 507 by the bundled sheet discharging belt 503.

On and after that, the movement of every sheet at a seventh page, at an eighth page and at a ninth page in a third bundle is similar to that of every sheet at the fourth page, at the fifth page and at the sixth page shown in the drawings of FIG. 12C.

In the first embodiment, the carry-in speed into the two-sided conveying path used also as a sheet retaining unit is adapted to be a uniform speed, and the carry-out speed is adapted to be a double-speed. Moreover, in the second embodiment, similarly the carry-in speed is adapted to be a double-speed, and the carry-out speed is adapted to be a quad-speed. However, the carry in speed and the carry-out speed are not limited to the configurations of those embodiments, and can be obtained as arbitrary speeds by which processing can be performed between pages according to the configuration of an image forming apparatus.

Moreover, in the first and the second embodiments, when a sheet is retained in the two-sided conveying path 145, a reverse operation is performed by using the conveying path 143. However, it is possible to implement the control similar to that in these embodiments by adopting a configuration for performing the reverse operation by using the conveying path 142 for discharge without any dedicated path for reversing such as the conveying path 143.

Moreover, in an image forming apparatus adopting a configuration in which a conveying path for conveying a sheet directly from the conveying path 143 into the two-sided conveying path 145 is added to the configurations of the first and the second embodiments, the sheet may be retained in the two-sided conveying path 145 through the added conveying path, and may be discharged by the way similar to those of the first and the second embodiments at the time of discharging the sheet from the two-sided conveying path 145.

In the image forming apparatus having such a configuration, for example, it is possible to shorten the conveying interval between the fourth page of the sheets and the fifth page of the sheets, and it is also possible to reduce or eliminate the increasing amount of the conveying speed at the time of carrying in a sheet into the two-sided conveying path 145 to reduce the load of the motor.

Moreover, in the above-mentioned embodiments, descriptions have been given on the supposition that the number of pages of a bundle is three. If the number of the pages of one bundle increases, only repetitions of an operation similar to that of the sixth page of the sheets in the above-mentioned embodiments are performed for the increased sheets.

Moreover, the number of sheets to be retained in the two-sided conveying path 145 or the reverse conveying path 143 for awaiting stapling processing has been supposed to be two, but it is also possible to perform a similar operation by increasing the number of sheets to be retracted in the case where the stapling processing takes a long time. Conversely, in the case where the stapling processing takes a short time, similar effects can be obtained even if the number of sheet to be retracted is set to be one.

Moreover, the processing executed in the finisher 500 is not limited to the stapling processing shown in the embodiments, but the control similar to that in the embodiments can be performed in all of the processing which can be conceived as to the discharged sheets such as adjustment, punching, folding, and binding.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-082410 filed Mar. 22, 2004 and No. 2005-065360 filed Mar. 9, 2005, which are hereby incorporated by reference herein.

What is claimed is:

1. An image forming apparatus capable of connecting to a sheet post-processing equipment, comprising:

an image data inputting unit configured to input a plurality of pages of image data to be formed as images on sheets;

an image forming unit configured to form the image on the sheet based on the image data inputted with the inputting unit;

a retaining unit including a first conveying path branching from a second conveying path of the sheet post-processing equipment, the retaining unit temporarily retaining the sheet having the image formed thereon by the image forming unit, and then while the sheet post-processing equipment is performing post-processing of a sheet bundle, conveying the sheet to the sheet post-processing equipment; and a control unit differentiating an order of pages on which the image is formed from an order of pages at a time of normally forming the image in the sheet bundle, as to which the sheet post-processing equipment performs the post-processing.

2. An image forming apparatus according to claim 1, wherein the control unit changes an order of a part of pages of sheets which should be retained in the retaining unit and sheets which are not necessary to be retained in the retaining unit.

* * * * *